US006394484B1

(12) United States Patent
Maravetz et al.

(10) Patent No.: US 6,394,484 B1
(45) Date of Patent: May 28, 2002

(54) SNOWBOARD BOOT AND BINDING

(75) Inventors: Paul T Maravetz, Burlington; Joshua Stewart Reid, Stowe; Gavin M. McMorrow, Shelborne, all of VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 08/887,530

(22) Filed: Jul. 3, 1997

Related U.S. Application Data

(60) Provisional application No. 60/044,715, filed on Apr. 18, 1997.

(51) Int. Cl.[7] ..... A63C 9/10; A63C 9/20

(52) U.S. Cl. ..... 280/624; 280/14.22

(58) Field of Search ..... 280/7.12, 7.13, 280/11.33, 624, 625, 626, 631, 632, 613, 615, 617, 14.21, 14.22; 36/115, 117.2, 117.3, 117.4, 132, 31

(56) References Cited

U.S. PATENT DOCUMENTS

| | | | | |
|---|---|---|---|---|
| 2,154,019 A | | 4/1939 | Westphal | |
| 2,554,706 A | | 5/1951 | Johansen | |
| 2,686,059 A | | 8/1954 | Whitaker | |
| 2,693,967 A | * | 11/1954 | Jones, Jr. | 280/613 |
| 2,836,428 A | | 5/1958 | Marker | |
| 2,846,232 A | | 8/1958 | Schnell | |

(List continued on next page.)

FOREIGN PATENT DOCUMENTS

| | | |
|---|---|---|
| EP | 0 719 505 | 7/1996 |
| EP | 0 768 103 A1 | 4/1997 |
| FR | 2 604 913 | 4/1988 |
| FR | 2 732 230 | 10/1996 |
| FR | 2 749 520 | 12/1997 |
| WO | WO 93/14835 | 8/1993 |
| WO | WO 95/09035 | 4/1995 |
| WO | WO 96/36407 | 11/1996 |
| WO | WO 97/03734 | 6/1997 |

OTHER PUBLICATIONS

English language translation of FR 2 604 913.
LAMAR Snowboards 1998 Dealer Catalog.
PCT International Search Report.

*Primary Examiner*—Frank Vanaman
(74) *Attorney, Agent, or Firm*—Wolf, Greenfield and Sacks, P.C.

(57) ABSTRACT

A snowboard boot and binding. In one embodiment, the binding comprises a base; a strapless engagement member that is mounted to the base and is arranged to engage with a forward region of the boot; and a strap that is mounted to the base and is arranged to engage with the boot to hold the heel end of the boot in the binding. In another embodiment, the binding comprises a strapless engagement member that is biased for movement relative to the base, is adapted to engage the boot, and is mounted to the base at a position that is arranged to underlie the boot sole. In a further embodiment, the binding comprises a strapless engagement member that is arranged to underlie the boot sole and that has a toe-facing opening to receive a corresponding mating feature on the boot. In another embodiment, a snowboard boot is provided that comprises a sole having an opening in its bottom surface, and a patch that is attached to the sole and is arranged to cover the opening in the sole. The patch may be a tear-away patch, or may be removably mountable to a mounting feature in the boot so that the patch can be separated from the sole to uncover the opening, and can be reattached to cover the opening. In a further embodiment, the boot includes a binding mating feature and at least two mounting features that are adapted to mount the binding mating feature to the sole in at least two spaced apart positions.

73 Claims, 12 Drawing Sheets

U.S. PATENT DOCUMENTS 3,009,710 A 11/1961 Marker
3,204,973 A 9/1965 Vöster et al.
3,351,353 A * 11/1967 Weitzner ..... 280/7.13
3,398,969 A 8/1968 Perry
3,525,166 A 8/1970 Rieker et al.
3,526,976 A * 9/1970 Jacobs ..... 280/7.13
3,608,919 A 9/1971 Lollmann et al.
3,618,233 A * 11/1971 Eie ..... 36/117.3
3,775,866 A 12/1973 Marker
3,779,570 A 12/1973 Betschart, Jr.
3,785,668 A 1/1974 Marker
3,834,723 A 9/1974 Erlebach
3,854,743 A * 12/1974 Hansen ..... 36/117.4
3,964,758 A 6/1976 Kent
3,984,124 A 10/1976 Gertsch
4,021,056 A 5/1977 Oakes
4,168,085 A 9/1979 Faulin
4,353,574 A 10/1982 Faulin
4,392,666 A 7/1983 Ramer
4,571,858 A 2/1986 Faulin
4,703,946 A 11/1987 Nava
4,836,572 A * 6/1989 Pozzobon ..... 280/613
4,887,833 A 12/1989 Bailey
4,907,817 A * 3/1990 Schwarz ..... 280/615
4,915,406 A * 4/1990 Graillat ..... 280/615
4,941,274 A 7/1990 Janos et al.
4,945,658 A 8/1990 Provence
4,979,760 A 12/1990 Derrah
5,020,823 A 6/1991 Bogner
5,052,709 A * 10/1991 Girault et al. ..... 280/615
5,066,036 A 11/1991 Brouthton
5,142,798 A 9/1992 Kaufmann et al.
5,190,310 A 3/1993 Hauglin et al.
5,207,446 A * 5/1993 Arnulf et al. ..... 280/615
5,401,041 A 3/1995 Jespersen
5,446,977 A * 9/1995 Nagano et al. ..... 36/131
5,474,322 A 12/1995 Perkins et al.
5,505,477 A 4/1996 Turner et al.
5,556,123 A 9/1996 Fournier
5,558,355 A 9/1996 Henry
5,577,757 A * 11/1996 Riepl et al. ..... 280/617
5,595,396 A 1/1997 Bourdeau
5,660,410 A * 8/1997 Alden ..... 280/14.2
5,794,963 A * 8/1998 Girard ..... 280/615
5,845,421 A * 12/1998 Tanaka ..... 36/117.3

* cited by examiner

SNOWBOARD BOOT AND BINDING

CROSS REFERENCE TO RELATED APPLICATIONS

This application claims the benefit of prior filed provisional application No. 60/044,715, filed Apr. 18, 1997, and entitled "SPEED BINDING".

BACKGROUND OF THE INVENTION

1. Field of the Invention

The present invention relates to a snowboard binding for interfacing a boot to a snowboard.

2. Discussion of the Related Art

Conventional binding systems for soft snowboard boots are of two general types. A first type (referred to herein as a "strap binding") typically includes a rigid high-back support into which the heel of the boot is placed, and two or more straps that secure the boot to the binding. Such bindings can be somewhat inconvenient to use. In particular, in contrast to ski bindings, a snowboard rider must typically disengage his or her foot from the rear binding at the completion of each run, because the rear foot is typically used to push the rider along the snow when maneuvering through the lift line and onto the chair lift. Thus, when using a binding that employs two or more straps, the rider must unbuckle each strap to release the boot when getting on the chair lift, and must re-buckle each strap before the next run.

To address the inconvenience of conventional strap bindings, a second type of binding (referred to herein as a "strapless binding") has more recently been developed that employs rigid engagement members to releasably engage the boot to the binding. These systems typically include either a handle that must be actuated to move the engagement members into engagement with the snowboard boot, or are step-in systems that are automatically actuated by the rider simply stepping into the binding. Examples of such strapless binding systems are disclosed in U.S. Pat. No. 5,299,823 (Glaser) and U.S. Pat. No. 5,520,406 (Anderson).

The bindings disclosed in the Glaser and Anderson patents are typical of most strapless bindings in that they employ a metal plate that is attached to the sole of the boot and is adapted to be releasably engaged by the binding. The binding further includes metal engagement members for engaging with the plate attached to the sole of the boot, resulting in a rigid metal-to-metal engagement between the boot and binding.

Although they address the convenience concerns of conventional strap bindings, strapless bindings still have not been readily accepted by most riders. As mentioned above, these systems typically require that the snowboard boot include a rigid metal plate attached to its sole. The metal plate increases the weight of the boot and its complexity of manufacture, and makes the boot significantly less comfortable to walk in than a conventional soft snowboard boot. In this respect, it should be understood that conventional soft snowboard boots are, in contrast to hard shelled ski boots, very flexible and comfortable to walk in. Thus, riders have become accustomed to walking about comfortably in their soft snowboard boots.

Furthermore, most strapless bindings require a metal-to-metal contact between the binding and the plate attached to the boot sole. Such an interface results in the sole of the boot being attached more rigidly to the binding than with a strap binding, which results in a riding performance and feel that many riders find to be different from strap bindings. In particular, the straps employed in a strap binding are typically formed of a plastic material that is at least somewhat flexible. Thus, no matter how tightly a rider adjusts the straps in a strap binding, the flexibility of the strap material and the arrangement of the binding straps enable the sole of the rider's boot to roll laterally when riding (referred to herein as foot roll). This lateral roll provides greater flexibility to the rider, and results in strap bindings having a performance and feel that most riders prefer to that provided by the rigid interface between the boot sole and binding in conventional strapless bindings, which clamp the sole of the boot to the binding and do not allow the boot sole to roll laterally.

In view of the foregoing, it is an object of the present invention to provide an improved snowboard binding for mounting a boot to a snowboard.

SUMMARY OF THE INVENTION

In one illustrative embodiment of the invention, a snowboard binding is provided for securing a snowboard boot to a snowboard, the snowboard boot having a toe end, a heel end and a length extending between the toe and heel ends. The snowboard binding comprises a base; a strapless engagement member that is mounted to the base and is arranged to engage with a portion of the snowboard boot that is disposed on a forward region of the boot extending between a center of the length of the boot and the toe end of the boot; and a strap that is mounted to the base and is arranged to engage with the boot to hold the heel end of the boot in the binding.

In another illustrative embodiment of the invention, a snowboard binding is provided that comprises a base and a strapless engagement member, movably mounted to the base, that is adapted to engage with the snowboard boot. The strapless engagement member is mounted to the base at a position that is arranged to underlie the sole of the snowboard boot when the boot is engaged by the binding and is biased for movement relative to the base.

In a further illustrative embodiment of the invention, a snowboard binding is provided that comprises a base having a toe end and a heel end; and a strapless engagement member mounted to the base at a position that is arranged to underlie the sole of the snowboard boot when the boot is engaged by the binding. The strapless engagement member has an opening adapted to receive a corresponding mating feature on the snowboard boot, and is arranged so that the opening faces the toe end of the base.

In another illustrative embodiment of the invention, a snowboard boot is provided that comprises a sole having an opening in its bottom surface, and a tear-away patch that is attached to the sole and is arranged to cover the opening in the bottom surface of the sole.

In a further illustrative embodiment of the invention, a snowboard boot is provided that comprises a sole having an opening in its bottom surface; a binding mating feature that is adapted to engage with a snowboard binding to mount the boot to a snowboard, the binding mating feature being disposed in the opening in the bottom of the sole; a detachable patch that is arranged to cover the opening in the bottom of the sole and the binding mating feature; and a mounting feature, supported by the sole, that is adapted to mount the detachable patch to the sole so that the patch can be separated from the sole to uncover the binding mating feature, and can be reattached to the sole to cover the binding mating feature.

In another illustrative embodiment of the invention, a snowboard boot is provided that comprises a sole having a bottom surface and an opening in the bottom surface; a mounting feature adapted to mount to the sole a binding mating feature that is adapted to engage with a snowboard binding to mount the boot to a snowboard, the mounting feature being disposed in the opening in the bottom of the sole; and a detachable patch that is arranged to cover the opening in the bottom surface of the sole and the mounting feature, the detachable patch being removably mountable to the mounting feature so that the detachable patch can be separated from the sole to uncover the opening, and can be attached to the mounting feature to cover the opening.

In a further illustrative embodiment of the invention, a snowboard boot is provided that comprises a sole; a binding mating feature that is adapted to engage with a snowboard binding to mount the boot to a snowboard; and at least two mounting features, supported by the sole, that are adapted to mount the binding mating feature to the sole in at least two spaced apart positions.

DETAILED DESCRIPTION

The present invention is directed to a method and apparatus for engaging a snowboard boot to a snowboard. In accordance with one illustrative embodiment of the invention, a binding is provided that includes a strapless forward engagement member that is adapted to mate with a corresponding feature on the snowboard boot to keep the front portion of the boot from lifting off the binding, and a strap that is adapted to hold the heel of the boot in the binding. The binding is more convenient than conventional strap bindings because there is no toe strap to be manipulated when getting into and out of the binding. Furthermore, the binding of the present invention advantageously provides the performance and feel of a conventional strap binding, because the rear strap, like the straps in a conventional strap binding, has sufficient flexibility to enable the sole of the boot to roll when riding. The strapless engagement member is adapted to hold the front of the boot down without clamping the boot sole to the binding, so that the sole of the boot is able to roll laterally with respect to the binding. Thus, the binding of the present invention provides the advantageous performance and feel of conventional strap bindings, while improving upon the inconvenient nature of such bindings.

Figure 1:
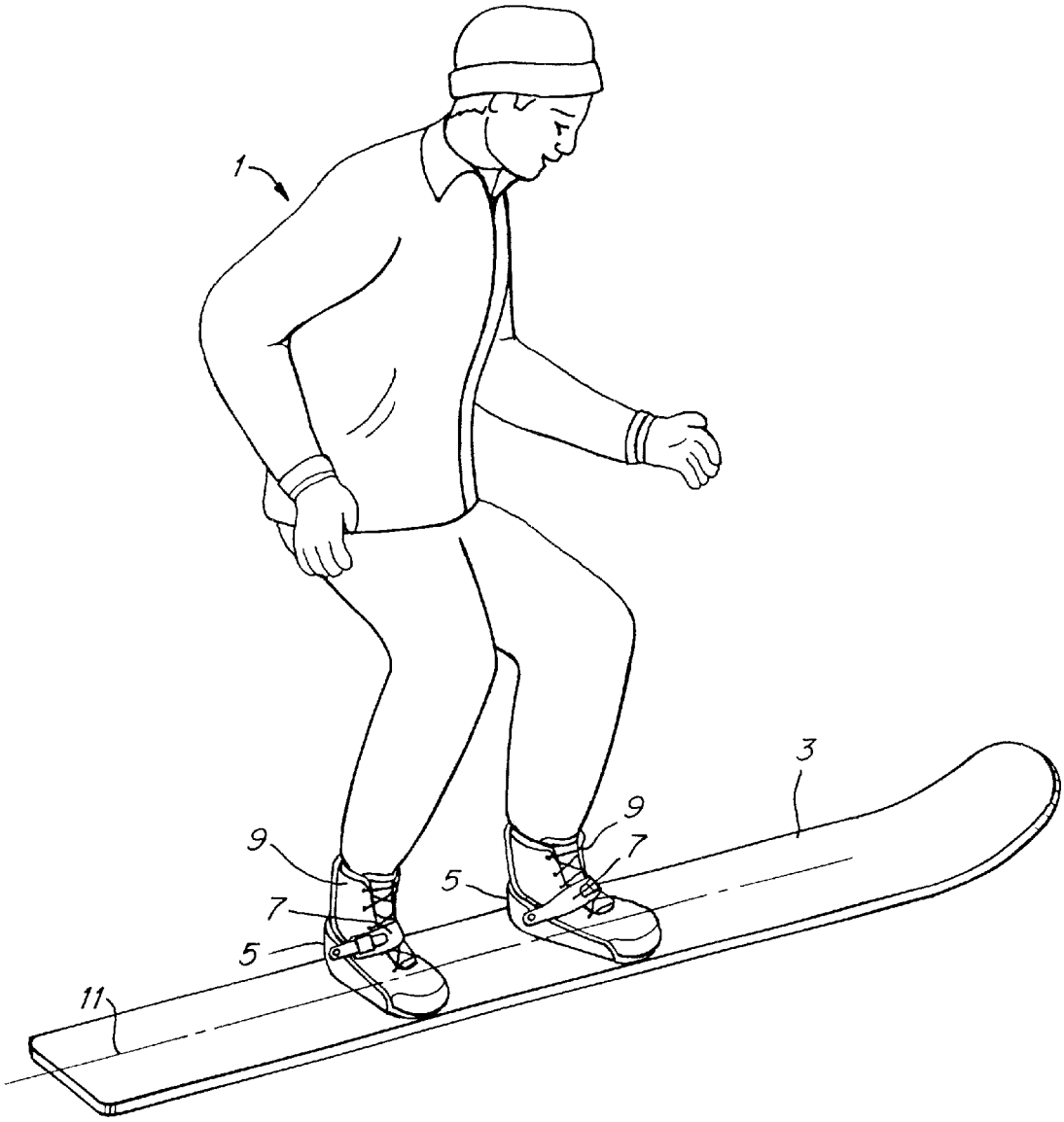
FIG. 1 illustrates a rider mounted to a snowboard using a boot and binding system in accordance with one embodiment of the present invention.

FIG. 1 is a perspective view of a rider 1 on a snowboard 3. A pair of bindings 5 in accordance with one illustrative embodiment of the present invention is mounted to the snowboard. Each of the bindings includes a single strap 7 for engaging with the rider's boots 9 to mount the rider to the snowboard 3.

In one illustrative embodiment, the aspects of the invention for engaging the boot are employed in a binding having the features disclosed in U.S. Pat. Nos. 5,261,689, and 5,356,170 (hereafter collectively "the related patents"), each of which is incorporated herein by reference. However, it should be understood that the present invention is not limited in this respect, and that the combination of the strapless engagement member and the rear strap of the present invention can be used in association with any number of other binding arrangements.

Figure 2:
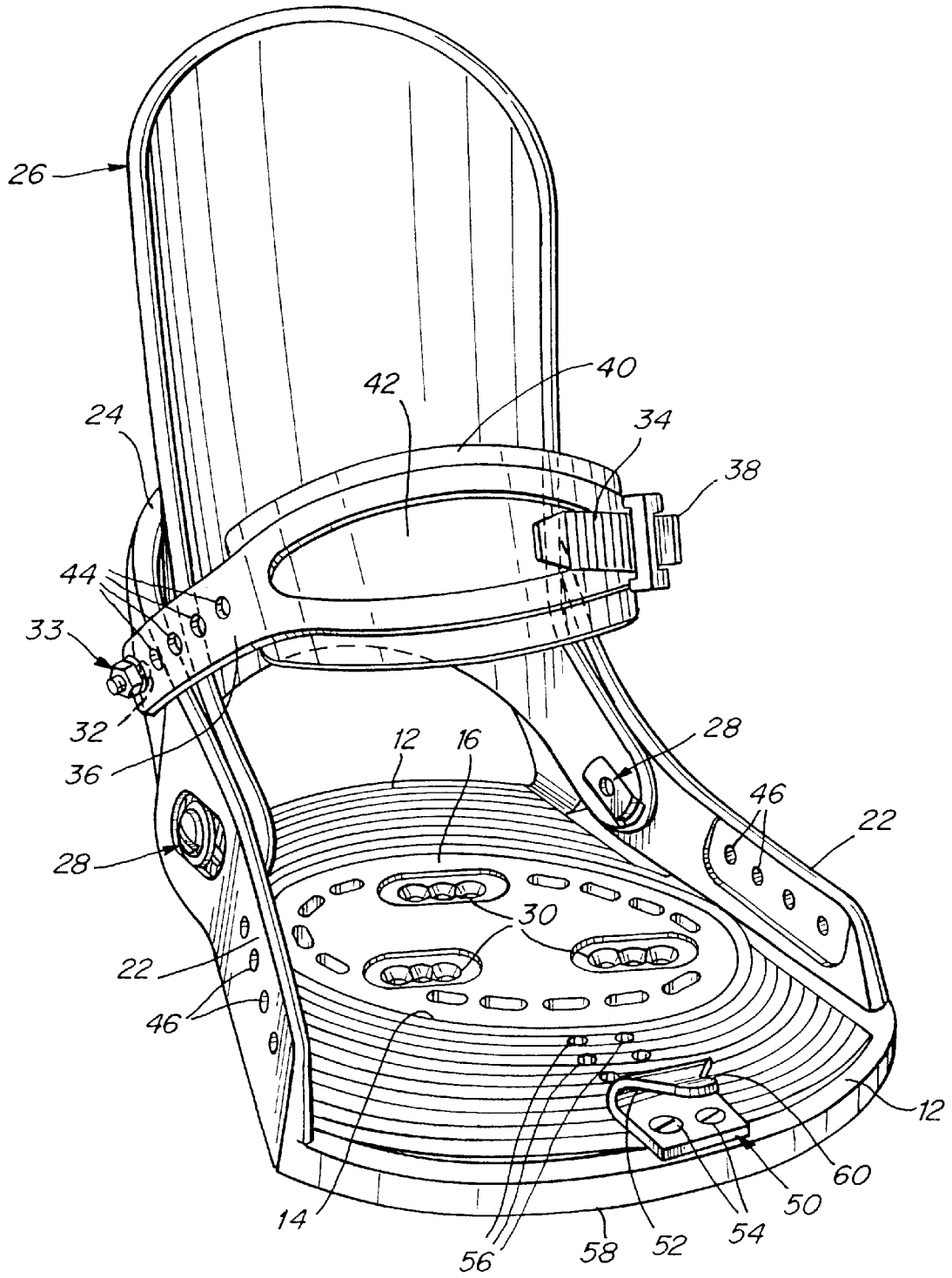
FIG. 2 is a perspective view of one illustrative embodiment of a binding in accordance with the present invention.
Figure 3:
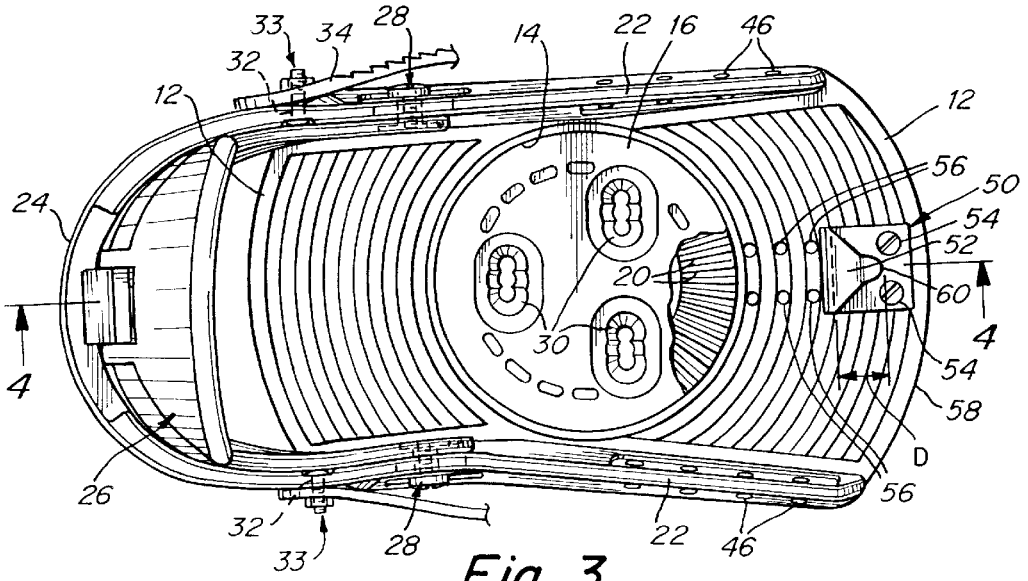
FIG. 3 is a top view of the binding of FIG. 2.
Figure 4:
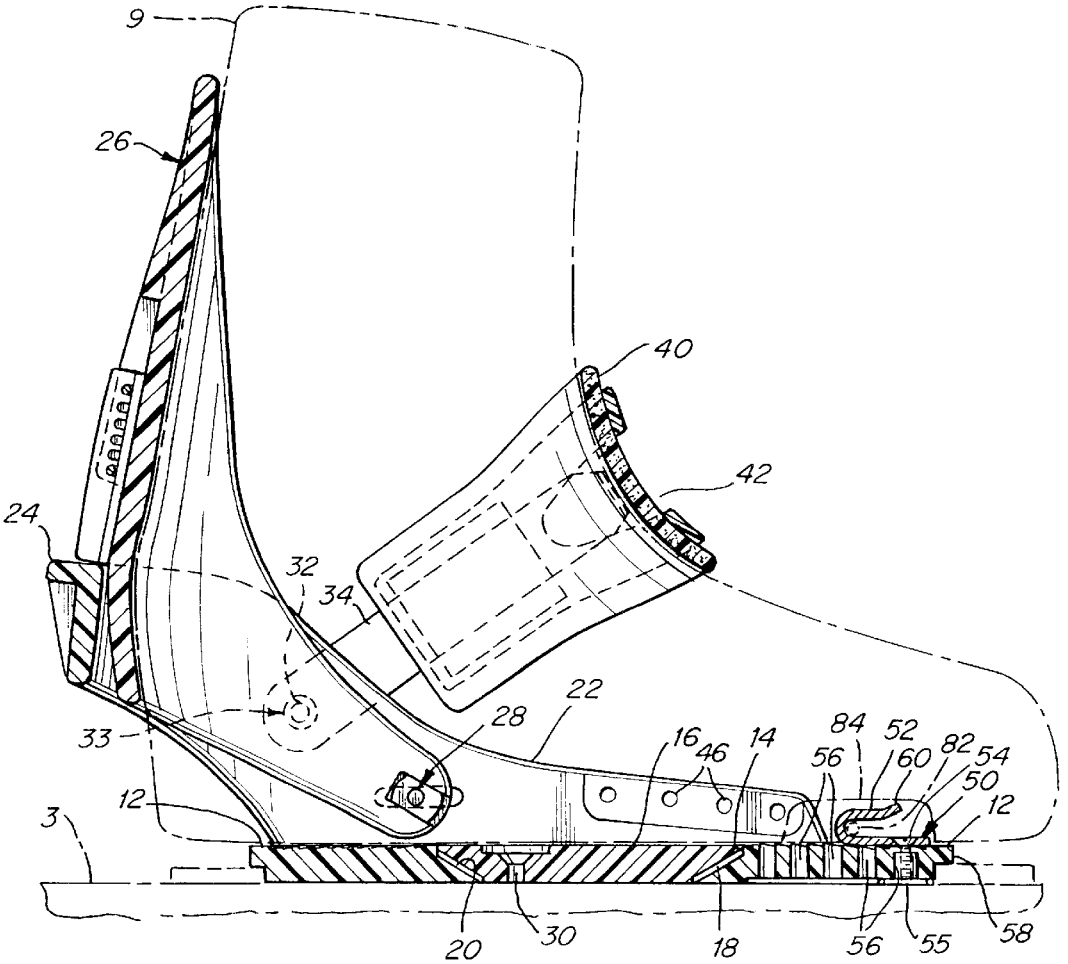
FIG. 4 is a cross-sectional side view of the binding of FIGS. 2–3 taken along line 4—4 of FIG. 3.

FIGS. 2–4 illustrate the embodiment of the present invention employed with a binding having the features disclosed in the above-referenced patents. These figures show a binding specifically adapted for the left foot of the rider. It should be understood that the binding for the right foot is substantially a mirror image of the left foot binding. Each binding includes a base plate 12 that is adapted to be mounted to the snowboard 3 (FIG. 1). The base plate has a central opening 14 that is adapted to receive a hold-down disc 16. The bottom surface of the hold-down disc 16 includes a plurality of ridges 18 that are adapted to engage with a corresponding set of ridges 20 in the area of the base plate 12 that defines the central opening 14. Thus, the base plate 12 of the binding can be adjusted to a plurality of different positions with respect to the hold-down disc 16, thereby enabling the orientation of the base plate relative to the longitudinal axis 11 (FIG. 1) of the board 3 to be adjusted to suit the rider's preference, as discussed in the related patents.

The binding further includes a pair of sidewalls 22 that extend upwardly from the base plate 12 along the lateral sides of the binding. At the rear (i.e., heel) end of the binding, the lateral sidewalls 22 extend rearwardly beyond the end of the base plate 12, rising up to merge and form a curved heel wall 24. The base plate 12, sidewalls 22 and heel wall 24 can be formed from a single integral molded piece.

The illustrative embodiment shown in the drawings includes a high-back leg support 26 attached at two adjustable connection points 28 on the lateral sidewalls 22. The adjustable attachment points advantageously enable the high-back leg support to not only be folded down into a storage position, but also to be rotated about an axis that is substantially normal to the base plate 12, in the manner described in the related patents.

As further discussed in the related patents, the hold-down disc 16 in the illustrative binding shown in the figures includes a triangular hole pattern that includes a set of multiple repetitions of holes 30 that are adapted to receive screws to mount the binding to a snowboard that includes the hole pattern described in the related patents, such that the position of the bindings on the board can be adjusted to accommodate different riding stances.

As with the binding disclosed in the related patents, the illustrative embodiment shown in the figures includes a pair of holes 32 (one is shown in phantom in FIG. 2 and the other is shown in phantom in FIG. 4) adapted to attach a heel strap, via a fastener 33, for securing the rider's boot in the binding. The strap can be of the type used as the heel strap in conventional strap bindings, or can be any other type of suitable strap. In one embodiment of the invention, the strap includes a first strap portion 34 attached to the lateral side of the binding, and a second strap portion 36 attached to the medial side of the binding. The lateral strap portion 34 includes a plurality of teeth that are adapted to engage with a locking mechanism 38 that is attached to the free end of the medial strap portion. The locking mechanism 38 can be a ratchet-type buckle as described in U.S. Pat. No. 5,416,952, which is incorporated herein by reference, although numerous other locking mechanisms are possible. Once the teeth of the lateral strap portion are engaged with the buckle, the ratcheting feature can be used to tighten the strap down over the front of the rider's boot in the heel area. In the embodiment of the invention illustrated in the drawings, the medial strap portion 36 includes a pad 40 disposed over the inner surface of the strap to cushion the top of the rider's foot as the strap is tightened down over the top of the boot. In addition, the strap is split in the middle area 42 so that the strap does not bear upon the top of the rider's instep bone. The medial strap portion may include a plurality of holes 44 so that the attachment point of the medial strap portion to the binding can be adjusted to accommodate different boot sizes.

It should be understood that the specific strap arrangement shown in the drawings and described above is provided merely for illustrative purposes, and that the present invention is not limited to this or any other particular strap arrangement. All that is required is that a strap be employed that, when tightened down over the top of the rider's boot, enables the sole of the boot to roll laterally during riding.

This can be accomplished by employing a binding strap that has some flexibility, such as a typical strap in a conventional strap binding, which can be formed from an injection molded plastic (e.g., polyurethane), woven nylon, or any of a number of other materials. In addition, the locking mechanism employed with the strap can operate to securely hold the heel of the boot in the binding, while still providing enough give to enable the sole of the boot to roll laterally. Furthermore, although only a single strap is used in the embodiment of the present invention shown in the figures, it should be understood that the present invention is not limited in this respect. The present invention contemplates the use of a strapless engagement member that enables the toe strap of a conventional strap binding to be eliminated. This concept can be employed in a binding that includes two or more straps, and is not limited to a single strap. For example, in addition to a heel strap, another strap can be provided to engage the boot about the rider's lower shin.

In the embodiment shown in the drawings, the sidewalls 22 include a plurality of holes 46 that are adapted to secure a toe strap in a number of different positions to accommodate different boot sizes when the binding is arranged as a conventional strap binding in the manner described in the above-referenced patents. Since the toe strap is eliminated in the present invention, the plurality of holes 46 can also be eliminated. However, in one embodiment of the invention, the plurality of holes is included in the sidewalls 22 so that a single mold can be used in manufacturing a binding component used in forming the strap binding described in the related patents, and a binding in accordance with the present invention. This provides the advantageous feature of providing the rider with flexibility and adjustability in terms of switching between the type of boot and binding interface employed with the binding. In particular, by removing the strapless engagement member (e.g., 50 in FIGS. 2–4) from the base plate 12 and attaching a toe strap to the holes 46, the rider can use the binding in the conventional manner described in the related patents. Similarly, in accordance with another illustrative embodiment of the invention, the binding base plate 12 in a strap binding (e.g., as disclosed in the related patents) can be provided with mounting features for mounting a strapless engagement member thereto, so that the rider has the option of removing the toe strap and attaching a strapless engagement member to convert the binding into one that employs the advantageous features of the present invention described above.

The illustrative embodiment shown in FIGS. 2–4 includes a strapless forward engagement member 50 for engaging a forward section of the rider's boot to prevent it from lifting from the base plate 12 when riding. It should be understood that the strapless forward engagement member 50 can be implemented in any number of ways, and that the present invention is not limited to the particular implementations shown in the drawings, which are provided merely for illustrative purposes.

In the embodiment shown in FIGS. 2–4, the strapless forward engagement member 50 includes a hook 52 for engaging a mating feature (e.g., a bar 82 in FIGS. 7–8, a bar 92 in FIGS. 9–10 and cavity 106 in FIGS. 12–13) that is disposed in the sole of the boot in any of a number of ways as described below. The strapless forward engagement member 50 can be formed from hardened steel, aluminum, or some other rigid material such as glass filled nylon, or possibly even a non-reinforced plastic such as rubber or polyurethane. When formed from metal, the engagement member can be formed by casting or bending the metal piece to form the hook 52, leaving sufficient room for the bar or other mating feature in the boot sole to be disposed under the hook 52. When formed from a plastic material, the member 50 can be molded using any of a variety of suitable techniques such as injection molding. The forward engagement member 50 can be attached to the base plate 12 via a set of screws 54 and T-nuts 55, or any other technique that would provide a sufficiently strong engagement to resist the lifting forces applied to the forward engagement member when riding. Alternatively, as discussed in more detail below, the forward engagement member 50 can be molded integrally with the base plate 12. In the embodiment of the invention shown in the figures, the hook 52 defines an opening that faces toward the front of the binding, such that the rider draws the forward portion of the boot backward when stepping into the binding to engage with the forward engagement member 50. As discussed below, in other embodiments of the invention, the hook can alternatively be disposed facing rearwardly.

In one embodiment of the invention, the base plate 12 is provided with a plurality of holes 56 that are adapted to receive the screws 54 for mounting the forward engagement member 50 in a number of different positions along the length of the base plate to accommodate different boot sizes. The mating member on the boot can be fixed thereto so that it is not adjustable by the rider, thereby reducing the possibility of misalignment when the strapless engagement member 50 is set in the appropriate set of holes 56 for the corresponding boot size. Alternatively, in another embodiment of the invention discussed below, the mating member on the boot can be releasably attached thereto to enable the rider to adjust the position of the mating member on the sole.

The optimal positioning of the strapless forward engagement member 50 along the length of the base plate 12 is impacted by a number of factors. First, the engagement member 50 should be positioned on the base plate so that it will engage and lock down the corresponding mating member on the boot when the rider's heel is securely inserted in the back of the binding. In general, the further forward the mating member (e.g., bar 82 in FIG. 7) is disposed on the boot, the easier it is for the rider to engage it with the forward engagement member 50 when stepping into the binding. In view of the fact that the toe of the boot will generally overhang the toe edge of the board when riding, it is desirable to mount the mating member on the boot such that it does not extend beyond the length of the boot in the toe area. The mating member can be disposed on the boot as close as 1 cm from the most forward edge of the rubber outer sole of the boot using mounting techniques such as those described below. However, in one embodiment of the invention, the placement of the mating member on the boot is measured forward from the heel end of the boot, so that boots of at least two different sizes can have the mating member disposed in the same location relative to the binding. Thus, in at least one of its adjustment positions provided by the plurality of holes 56 in the base plate 12, the strapless forward engagement member 50 can be used to receive boots of at least two different sizes. The forward engagement member 50 can be disposed as far rearwardly as the center line that marks the midway point between the toe and heel along the length of the boot, and in one embodiment of the invention for a size nine boot, is disposed approximately 4 cms from the forward toe edge of the boot's outer sole.

As mentioned above, the position of the forward engagement member 50 along the length of the base plate 12 can be adjusted using the plurality of holes 56 to accommodate boots of different sizes. The toe of the boot will typically extend some distance beyond the forward edge 58 of the base plate for some boot sizes. Thus, the forward engagement member 50 can be positioned all the way up to the forward edge 58 of the base plate, and may even overhang and extend beyond the edge 58, without extending beyond the toe edge of the boot. In addition, the holes 56 can extend rearwardly as far as is desired to accommodate positioning of the engagement member 50 so that it will underlie the boot mating member (e.g., 82 in FIG. 7), which may be disposed as far back as the midway point along the length of the boot. In the embodiment shown in the figures, the plurality of holes 56 extends only as far back as the opening 14 in the base plate that is adapted to accommodate the hold-down disc 16, because as discussed briefly above, the rotational orientation of the base plate 12 can be adjusted with respect to the hold-down disc 16, which would result in an offsetting of any of the plurality of holes 56 extending across the hold-down disc 16.

Figure 3A:
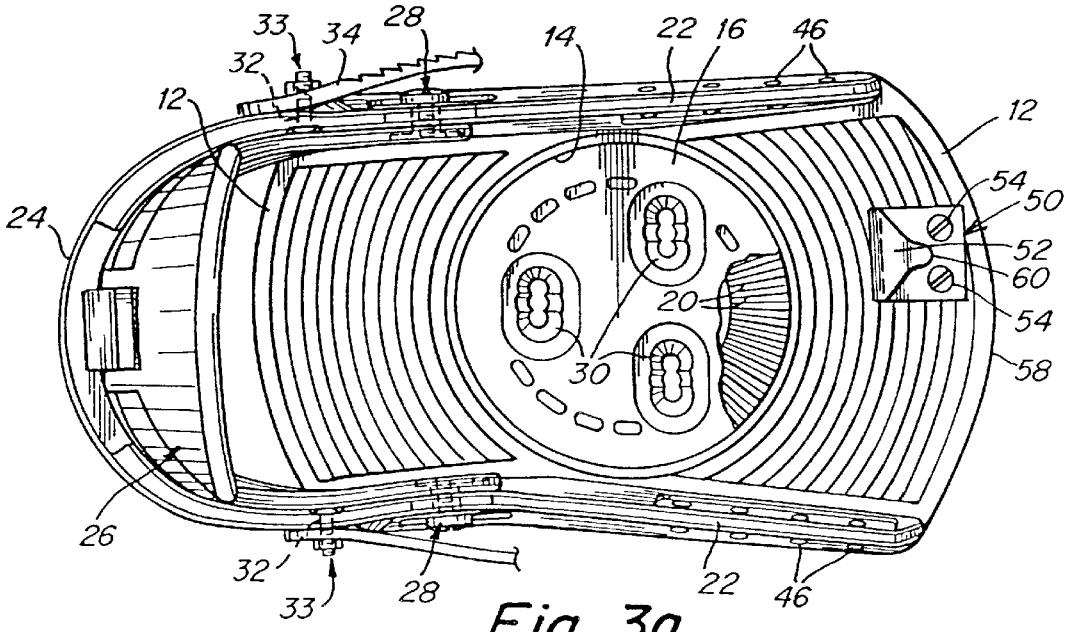
FIG. 3*a* is a top view of an alternative embodiment of the binding of FIG. 2.

The positioning of the strapless forward engagement member 50 across the width of the base plate 12, as well as the positioning of the corresponding mating member across the width of the boot sole, impacts the performance of the system. In particular, when these elements are respectively disposed along the center line midway across the width of the binding and boot, foot roll (defined herein as a rolling of the boot sole relative to the base plate 12) will be achieved in both the medial and lateral directions. Offsetting the mating member in the boot and the portion (e.g., hook 52) of the strapless engagement member that is adapted to engage it toward the lateral (FIG. 3*a*) side of the boot will reduce foot roll toward the medial side of the boot. Conversely, offsetting these members toward the medial side of the boot will reduce foot roll toward the lateral side of the boot. Thus, the position of the forward engagement member 50 and the corresponding mating member on the boot can be adjusted to control and achieve the desired direction of foot roll. In addition, in one illustrative embodiment of the invention, two separate strapless engagement members (e.g., 50 in FIGS. 2–4) are employed across the width of the base plate 12, to separately control the amount of foot roll in the medial and lateral directions.

Figure 3B:
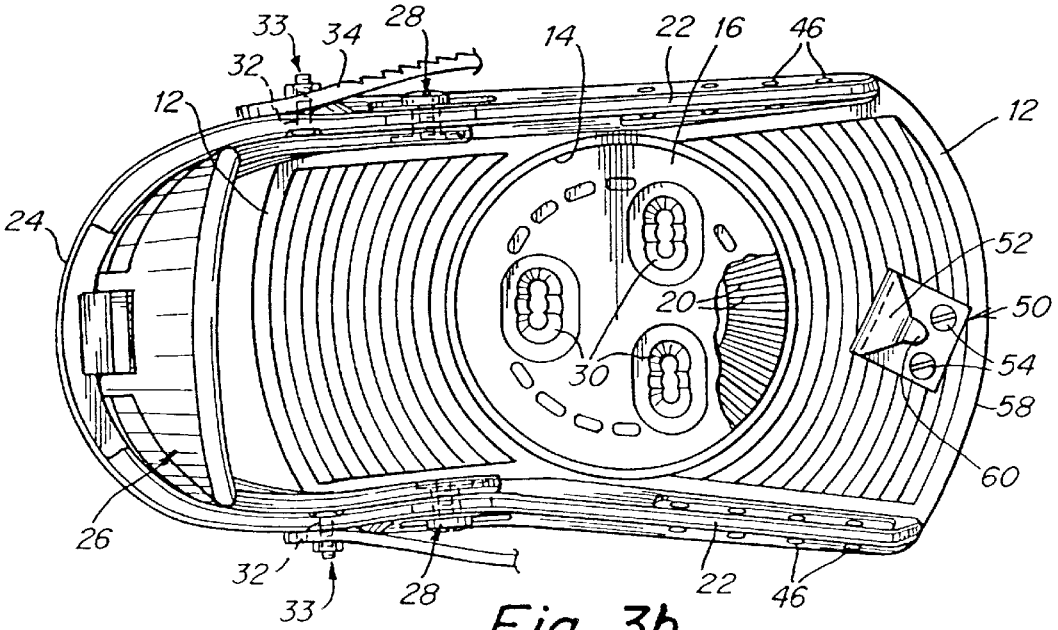
FIG. 3*b* is a top view of an alternative embodiment of the binding of FIG. 2.

In one embodiment of the invention, the opening of the strapless engagement member 50 is arranged to be in-line with the direction of motion of the boot sole mating member as the rider steps into the binding, to thereby facilitate engagement between the boot and binding. In this embodiment of the invention, the forward engagement member 50 is mounted in an asymmetric fashion, such that the opening defined by the engagement member is offset slightly from the central axis along the length of the boot, with the hook opening facing slightly toward the medial side of the binding (FIG. 3*b*).

As discussed above, in the embodiment of the invention shown in FIGS. 2–4, the hook 52 of the strapless forward engagement member 50 faces the front of the binding. However, in an alternate embodiment of the invention (e.g., an embodiment shown in FIG. 5 discussed below), the open portion of the engagement member faces the rear of the binding. Different advantages can be achieved with each of these alternate embodiments.

In the rear-facing embodiment, the rider's boot is securely locked between the rear portion of the binding, including the high-back 26, and the strapless engagement member 50. As the rider steps into the binding, pressure exerted on the boot by the high-back 26 and the engagement between the mating feature on the boot sole and the forward engagement member 50 causes the boot to be tightly seated therebetween. Thus, when the rider steps into the binding, it is clear when the boot engages the forward engagement member and is secured to the binding thereby. In addition, the heel of the boot is advantageously seated firmly against the rear portion of the binding.

In contrast to the rear-facing embodiment, when the forward engagement member 50 faces the front of the binding as shown in FIGS. 2–4, the binding is relatively easier to step into and out of than in the above-described rear-facing embodiment, because the boot is not wedged between the high-back 26 and the forward engagement member 50. However, the front-facing embodiment does not provide the same wedging action wherein the boot is positively locked between the high-back 26 and the forward engagement member 50, and does not provide the same confirmation that the boot is engaged by the strapless member 50.

As should be appreciated from the foregoing, the present invention is not limited to either a forward or rear-facing strapless engagement member, and contemplates the use of both embodiments, each of which provides particular advantages.

As discussed above, the direction of foot roll achieved with the binding of the present invention can be controlled by varying the placement of the strapless forward engagement member 50 relative to the central axis of the binding. Another characteristic of the system that affects the amount of foot roll is the width of the hook portion 52 (FIG. 3) of the strapless engagement member. In particular, a relatively wide hook portion 52 can be used to control and limit the amount of foot roll experienced with the binding, whereas a relatively narrow hook portion 52 will have less impact on restricting the amount of foot roll. A range of acceptable widths for the hook portion 52 of the forward engagement member in accordance with one illustrative embodiment of the invention is from 5 mm to 3 cm, with one particular embodiment employing a width of 1.5 cm.

It should be appreciated that the width of the hook portion 52 of the forward engagement member also impacts the ease of insertion of the corresponding mating member (e.g., bar 82 in FIG. 7) in the boot sole. In particular, the narrower the hook portion 52, the easier it is to insert the boot sole mating member. Thus, to facilitate insertion of the boot sole mating member in the strapless engagement member, in one embodiment of the invention shown in FIGS. 2–4, the hook portion 52 narrows and extends outwardly to a point 60. Thus, at the thinnest outward point 60 that defines the mouth of the opening, it is relatively easy to slip the mating feature on the boot sole under the hook portion 52. As the boot sole member is drawn into further engagement with the hook portion 52, the engagement tightens up as more of the boot sole mating feature is engaged by the widening hook portion 52. In one embodiment of the invention, the hook portion 52 has a width of approximately 5 mm at the outward portion 60, and widens to approximately 3 cm at its widest point.

Ease of insertion of the boot sole mating member into the strapless engagement member is also facilitated in one embodiment of the invention by providing some lift to the forward portion 60 of the hook, as shown in FIG. 4. Thus, the opening formed by the hook portion 52 is largest at the mouth of the opening to facilitate insertion of the boot sole mating member, and then tapers to a smaller opening size.

The other relevant dimension of the forward engagement member is the depth D (FIG. 3) of the hook portion 52. The shallower the hook portion 52, the easier it is for the rider to fully engage the boot with the forward engagement member. However, the hook portion 52 should have sufficient depth to engage the corresponding mating member on the boot sole through a range of positions that accounts for all possible positions and forward lean adjustments for the high-back 26. In one embodiment of the invention, the hook portion 52 has a depth D within a range of 1–5 cm, and in one particular embodiment the depth is equal to approximately 2 cm.

Figure 5:
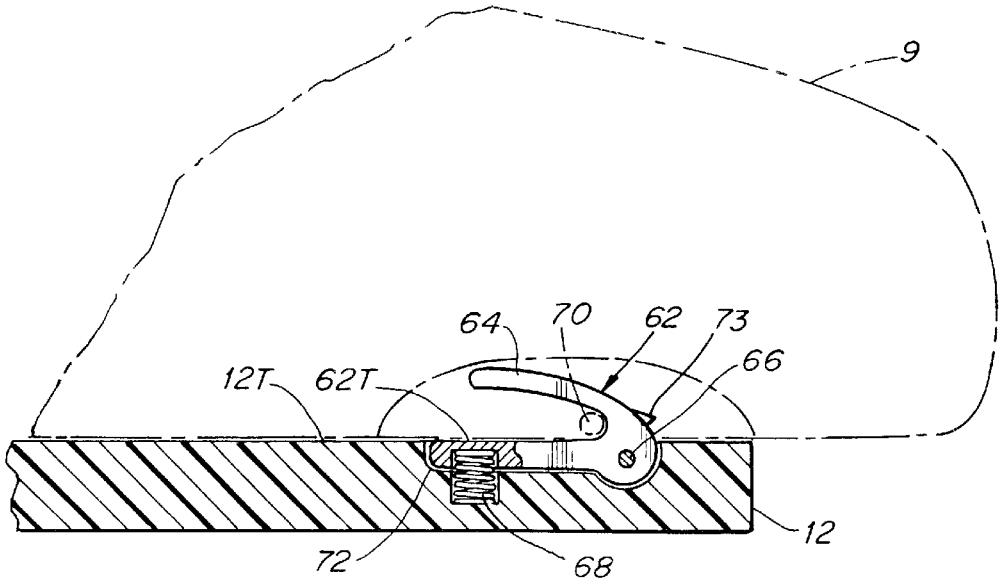
FIG. 5 illustrates an embodiment of a forward engagement member mounted to a binding in accordance with one embodiment of the present invention.

An alternate embodiment of the strapless engagement member is disclosed in FIG. 5. In this embodiment of the invention, the forward engagement member 62 includes a hook portion 64 that is similar in many respects to the hook 52 discussed in the embodiment above, but is oriented so that it faces the heel section of the binding. As discussed above, this embodiment provides the advantageous feature that the boot is firmly seated between the high-back 26 and the engagement member 62. However, it should be understood that in view of the rear wall 24 and the high-back 26 disposed at the heel of the binding, it would be difficult for the rider to place the heel of the boot down flush against the base plate 12, and then slide the boot forward so that the mating feature disposed on the sole can engage with the engagement member 62. In fact, when the boot is seated back against the high-back 26, the mating feature in the boot sole should be fully engaged with the hook 64, without having to be moved forward, as this corresponds to the position of the boot in the binding when riding. Thus, the embodiment of the invention disclosed in FIG. 5 provides a rear-facing engagement member 62 that is biased to facilitate engagement with the boot.

Figure 6:
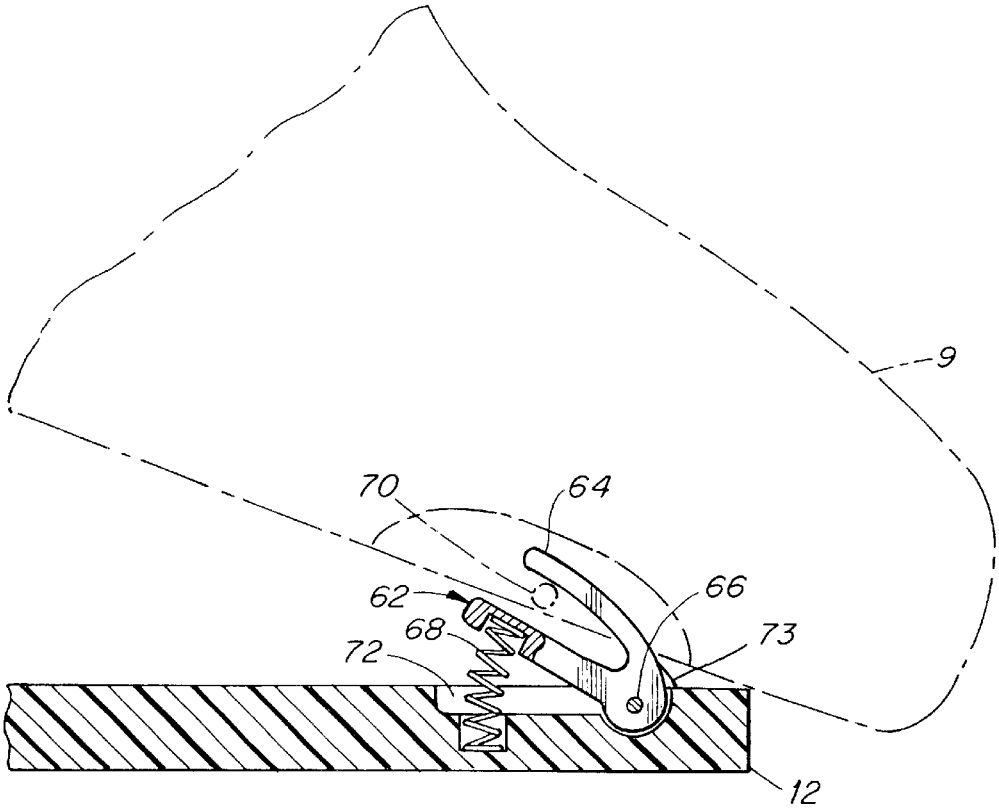
FIG. 6 is a schematic illustration of a boot stepping into the engagement member of FIG. 5.

As shown in the cross-sectional view of FIG. 5, the biased engagement member 62 is mounted to the base plate 12 via a hinge pin 66 that is embedded in the base plate 12 in any of a number of ways, examples of which are discussed below. The binding includes a spring 68 that biases the engagement member 62 for rotation upwardly about the axis defined by hinge pin 66. Thus, when stepping into the binding, the rider angles the boot in the manner shown in FIG. 6, such that the toe portion is lower than the heel portion. The biasing spring 68 causes the engagement member 62 to be angled upwardly in a position that facilitates entry of the mating feature 70 on the boot sole (which can be implemented in any number of ways as discussed below) under the hook 64. The rider can then bring the boot heel down into engagement with the rear portion of the binding, overcoming the force of the spring 68. As shown in the cross-sectional view of FIG. 5, the base plate 12 may include a recessed portion 72 underlying the bottom portion of the engagement member 62, such that when the rider has stepped into the binding, a top surface 62T of the engagement member disposed below the hook 64 lies flush with a top surface 12T of the base plate. In addition, the engagement member 62 may include a stop 73 that is adapted to engage with base plate 12 to limit rotation of the engagement member 62.

As mentioned above, the biased engagement member 62 can be mounted to the base plate for rotation in any of a number of ways. The present invention is not limited to any particular implementation. For example, the hinge pin 66 can be implemented with a rivet that is imbedded in the base plate. Alternatively, the hinge pin 66 can be molded into the base plate 12, and the engagement member 62 can be provided with a slot for allowing it to be snapped onto the hinge pin 66.

Several illustrative implementations of the mating member on the boot for engaging with the strapless forward engagement member on the binding will now be described. It should be understood that the mating member can have any of a number of configurations and can be attached to the boot in numerous ways. The present invention is not limited to the particular implementations discussed below, which are provided merely for illustrative purposes.

Figure 7:
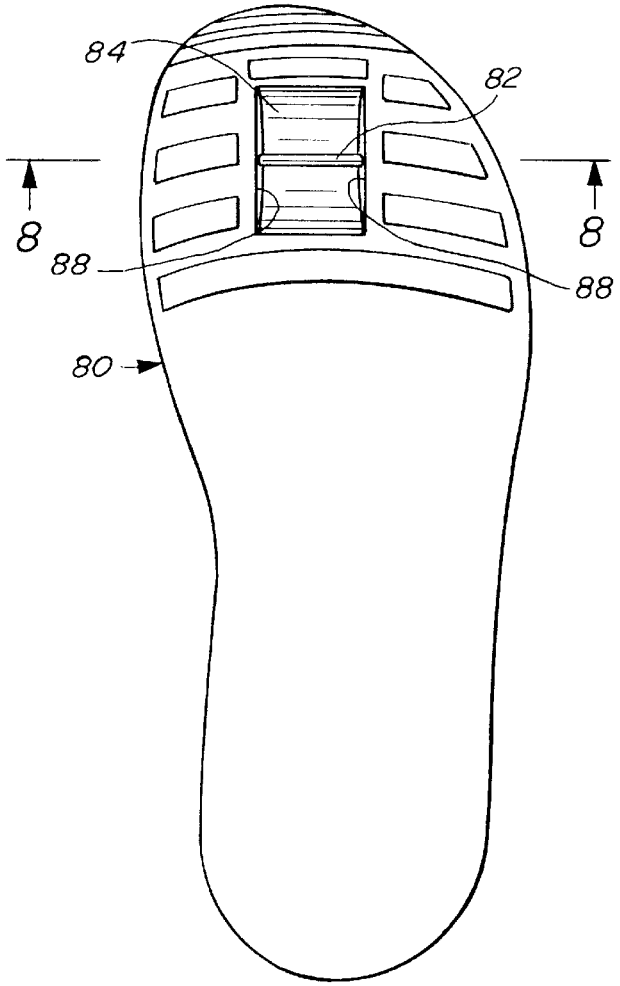
FIG. 7 is a bottom view of one illustrative embodiment of a boot having a binding mating feature in accordance with one illustrative embodiment of the invention.
Figure 8:
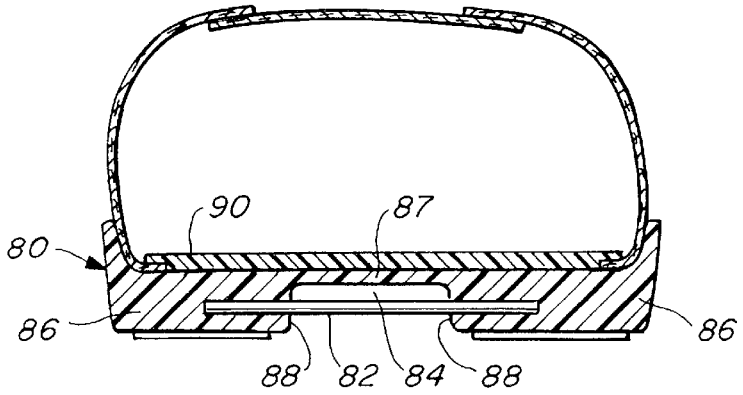
FIG. 8 is a cross-sectional view of the boot of FIG. 7 taken along line 8—8.

A first illustrative embodiment for the mating feature on the boot is shown in FIGS. 7–8. FIG. 7 is a bottom view of a boot sole 80 that includes a mating member 82 that is disposed in an opening or recess 84 in the sole. In this embodiment of the invention, the mating member 82 is a steel bar that is circular in cross-section. The bar 82 can be imbedded in the outer sole 86 of the boot (which may be rubber or any other suitable material) by disposing the bar 82 in a mold and then injecting the material for the outer sole 86 into the mold around the bar 82. In one embodiment of the invention, the recess 84 is sized to have a width that is approximately equal to that of the forward engagement member 50 (FIG. 4) with which it is designed to mate, with some slight clearance provided for an accumulation of snow. Thus, engagement between the front engagement member 50 and sidewalls 88 of the boot recess advantageously prevents the front of the boot from shifting from side-to-side when riding.

FIG. 8 is a cross-sectional view taken along line 8—8 of FIG. 7. In the embodiment of the invention shown in FIG. 8, a support member or shank 90 is disposed in the sole of the boot above the recess 84. The support member 90 stiffens the sole in the area above the recess, so that the sole does not sink down into the recess 84 under the rider's weight. The shank 90 can be in the form of an insole extending across the entire sole of the boot from the heel to toe. The shank can for example, be formed from nylon at a thickness of approximately 2 mm, which is not sufficiently stiff to impact the ability of the rider to walk in the boot, but which achieves the desired goal of preventing the sole in the area above the recess from sinking. Alternatively, the shank can extend across the full boot sole and have a reduced thickness in areas other than that above the recess 84, or can just be provided in that area.

Although the support member 90 provides the advantage discussed above, it is not necessary to practice the invention. Other techniques for ensuring that the sole does not sink down into the recess 84 can also be employed. For example, as is discussed more fully below, the strapless forward engagement member (e.g., 50 in FIGS. 2–4 and 62 in FIGS. 5–6) can be provided with a geometry that matches that of the recess 84, such that the upper portion of the forward engagement member can sit flush against the top of the recess 84, thereby supporting the boot sole in the area above the recess and preventing it from sinking into the recess when riding. The provision of a strapless engagement member having a geometry matching that of the recess 84 obviously provides no support for the recess 84 when the rider is not engaged in the binding and is walking about. However, support is much less critical at this time, because the forces generated on the recess 84 when walking are not nearly as great as those experienced when riding. Thus, the rigidity of the thinned out outer sole 87 in the area above the recess should be sufficient to prevent the sole from sinking into the recess when walking. In this respect, the outer sole can be thinned in the region 87 to approximately 1 mm, whereas the remainder of the outer sole 86 will have a more normal thickness ranging anywhere from 2–16 mm.

Figure 9:
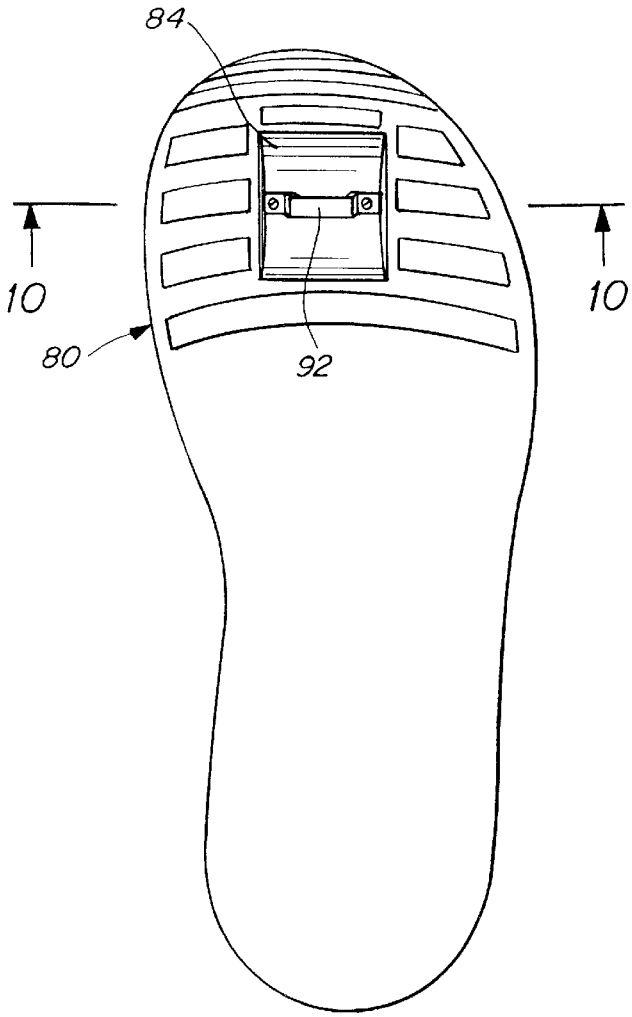
FIG. 9 is a bottom view of a boot employing an alternate binding mating feature in accordance with another illustrative embodiment of the present invention.
Figure 10:
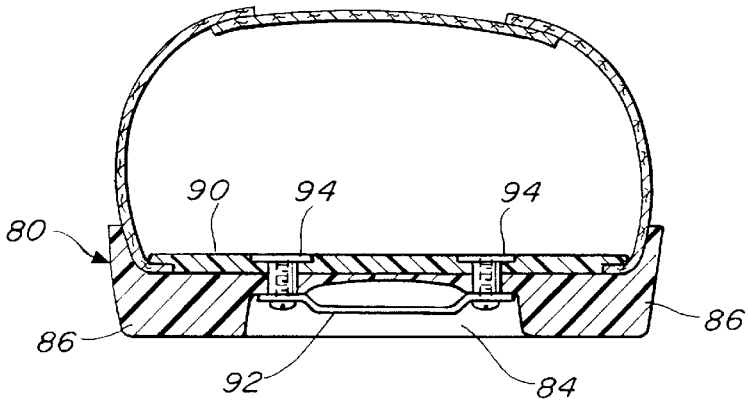
FIG. 10 is a cross-sectional view of the boot of FIG. 9 taken along line 10—10.

An alternate embodiment of the mating feature in the boot sole is shown in FIGS. 9–10, wherein a flat bar 92 is attached to the sole of the boot in the recess 84. As shown in the cross-sectional view of FIG. 10 (taken along line 10—10 of FIG. 9), this embodiment of the invention also employs a shank 90 in the sole of the boot to provide the stiffening feature discussed above. However, unlike the embodiment of FIGS. 7–8, the bar that forms the mating member 92 is not embedded in the sole, but rather, is attached to the shank 90 via a pair of screws and T-nuts 94.

As should be appreciated from the two embodiments described above, the mating feature attached to the sole of the boot need not have any particular shape. It can be a bar that is round in cross-section as shown in FIGS. 7–8, a flat strip as shown in FIGS. 9–10, or any other shape that enables the mating feature to engage with a corresponding strapless engagement member on the binding to hold down the forward portion of the boot when riding. For example, the mating feature need not be in the shape of a single bar, and can include two or more hooks for engaging with a corresponding strapless engagement member on the binding. Alternatively, the arrangement can be reversed so that the strapless engagement member on the binding can be a bar similar to the mating features 82 (FIG. 7) and 92 (FIG. 9), and the mating feature on the boot can be in the form of a rear or forward facing hook. The present invention is not limited to any specific implementation.

As seen from the cross-sectional views of FIGS. 8 and 10, in one illustrative embodiment of the present invention, the mating feature attached to the sole of the boot does not extend below the outer boot sole 86, and therefore does not impact the feel of the boot when the rider walks. It should be appreciated that in general, the lower the mating member extends, the easier it is for the rider to engage with the strapless engagement member on the binding. Thus, for the embodiments of the present invention wherein the mating member is implemented as a metal piece, it is desired to have the mating member extend just slightly above the bottom of the outer sole 86, such that the metal piece does not touch the ground when the rider walks. However, as discussed below, the mating member need not be formed from a metal piece, and can alternatively be formed from any of the materials discussed above as being suitable for use in forming the strapless forward engagement member, e.g., glass filled nylon, rubber or polyurethane. When formed from a non-metallic material, the mating feature on the boot sole can extend down to the point where it is flush with the bottom surface of the outer sole, such that it extends as low as possible to facilitate engagement with the binding without being noticeable to the rider when walking.

Figure 11:
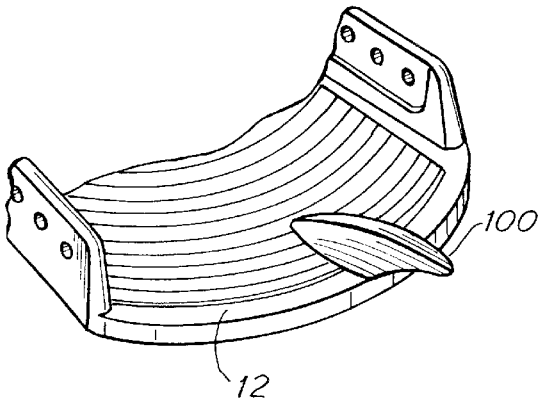
FIG. 11 is a partial schematic representation of an alternate forward engagement member for attachment to a binding in accordance with another embodiment of the present invention.
Figure 12:
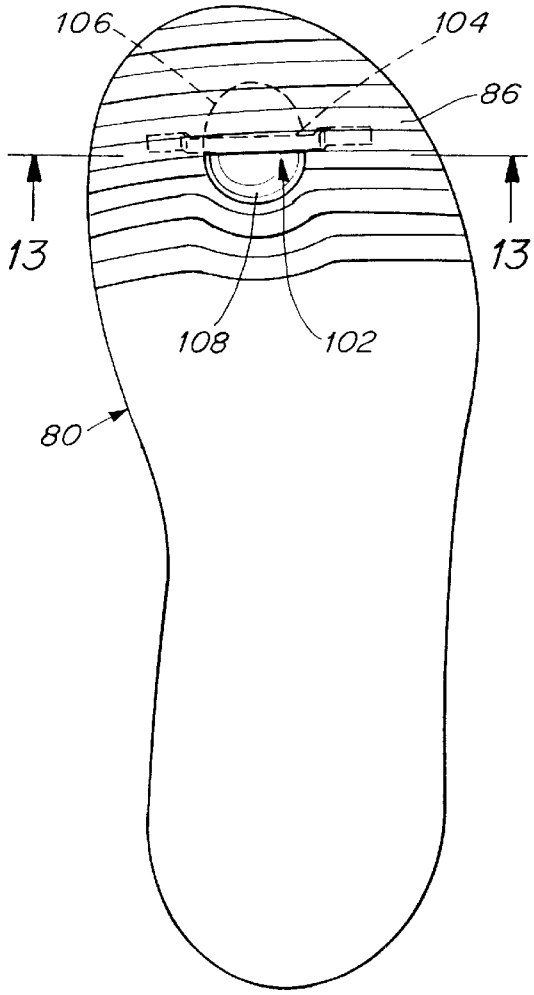
FIG. 12 is a bottom view of a boot including a mating feature adapted to mate with the engagement member of FIG. 11, in accordance with another illustrative embodiment of the invention.
Figure 13:
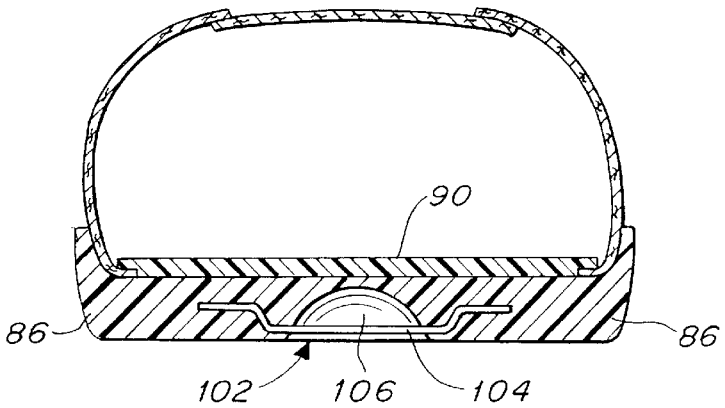
FIG. 13 is a cross-sectional view of the boot of FIG. 12 taken along line 13—13.

An alternate arrangement of a strapless engagement member for mounting to the binding and a corresponding mating feature in the boot sole is described making reference to FIGS. 11–13. FIG. 11 is a partial schematic view of the base plate 12 (FIGS. 2–4) showing a strapless engagement member 100 that is in the form of a sculpted toe hook. The toe hook 100 can be formed integrally with the base plate 12 in a single injection molding process and positioned in the same manner as the strapless member 50 (FIGS. 2–4) discussed above. Alternatively, the toe hook 100 can be formed separately from the base plate 12 to enable adjustment in the position of the toe hook 100 along the length of the binding, in much the same manner as discussed above with the strapless engagement member 50 shown in FIGS. 2–4.

FIGS. 12–13 illustrate a boot sole 80 that includes a mating feature 102 that is adapted to engage with the sculpted toe hook 100 of FIG. 11. In this embodiment of the invention, a support member 104 is disposed within the outer boot sole 86 (as shown in the cross-sectional view of FIG. 13, which is taken along line 13—13 of FIG. 12) and is not exposed by a recess in the outer boot sole 86. Rather, the mating feature 102 includes an opening in the sole defined by a hollowed out cavity 106, including a rear-facing mouth 108, that is adapted to receive the sculpted toe hook 100. The support member 104 is disposed below the cavity 106 and is adapted to support the outer sole 86 below the area wherein it is engaged by the sculpted toe hook 100. In addition, the boot sole may include a support member or shank 90 to prevent the sole from sinking in the area above the cavity 106 in much the same manner as the embodiments described above.

It should be understood that the support member 104 can be disposed within the outer boot sole 86 in the same manner as that described above in connection with the bar 82 in FIGS. 7–8. For example, the support member 104 can be disposed in a mold for forming the outer boot sole 86 and be embedded therein when the outer sole material 86 is injected into the mold about the support member 104.

In one illustrative embodiment of the invention, the dimensions of the cavity 106 are selected to match those of the sculpted toe hook 100, such that when the toe hook is inserted into the cavity, the toe hook substantially fills the cavity, allowing some slight clearance for an accumulation of snow. In this manner, when the rider steps onto the binding and engages the toe hook 100 within the cavity 106, the toe hook supports the upper surface of the cavity to prevent it from sinking under the weight of the rider. Thus, in this embodiment of the invention, the shank 90 can optionally be eliminated.

Figure 16:
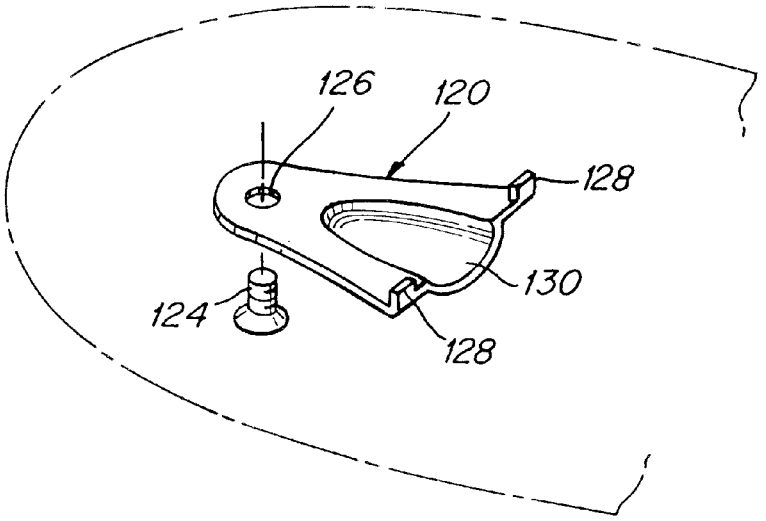
FIG. 16 is a perspective view of an alternate boot mating feature in accordance with another illustrative embodiment of the invention.
Figure 17:
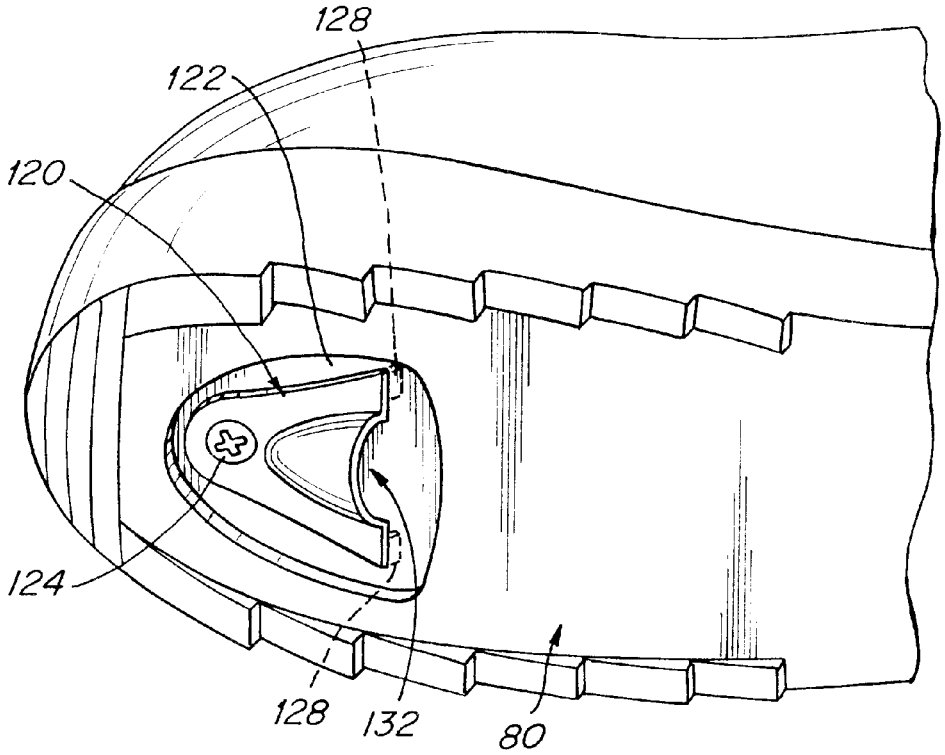
FIG. 17 is a perspective view of the mating feature of FIG. 16 attached to the sole of a boot.

FIGS. 16–17 illustrate an alternate embodiment of a boot sole mating feature 120 for engagement with a toe hook such as hook 100 shown in FIG. 11. The mating feature 120 is disposed within a recess 122 disposed in the boot sole 80, so that the mating feature 120 does not extend below the bottom of the boot sole 80, and therefore, does not impact the feel of the boot when the rider walks. The mating feature 120 is attached to the bottom of the boot sole via a fastener, such as a screw 124 that passes through an opening 126 in the mating feature and is received in a T-nut (not shown) in the boot sole. The mating feature 120 also includes a pair of tabs 128 that are adapted to be received in recessed portions (not shown) in the boot sole recess 122. The tabs 128 serve to prevent the mating feature 120 from rotating about the screw 124 during riding.

The mating feature 120 has a recessed top surface 130 that, when the mating feature 120 is attached to the boot sole recess 122, defines a cavity between the recessed surface 130 and a portion of the sole that defines boot sole recess 122. The cavity has an opening 132 and is configured to receive a toe hook (such as the hook 100 shown in FIG. 11) in much the same manner as the cavity 106 (FIGS. 12–13) described above.

The mating feature 120 shown in FIGS. 16–17 is advantageous in that it is detachable from the boot sole 80. Although attached to the boot sole via a single screw 124 in the embodiment shown in the figures, it should be understood that the invention is not limited in this respect. The detachable mating feature 120 can alternatively be attached to the boot sole with multiple screws, or with any of a number of other types of fasteners.

It should be understood that in addition to holding down the front portion of the boot, the toe strap in conventional strap bindings also provides downward pressure on the toes of the rider, providing a feel that many riders have become accustomed to. Thus, in one embodiment of the present invention, some mechanism is provided for providing comparable toe pressure in conjunction with the binding of the present invention, which eliminates the use of the toe strap. This mechanism can, for example, include a boot that employs a dual lace system, with one set of laces controlling the manner in which the boot is tightened above the toe area, and the other set of laces controlling the tightening of the remainder of the boot. In this manner, the rider can tighten down the lacing in the toe area more than the remainder of the boot, to provide the desired toe pressure. Alternatively, a buckle and strap can be provided along the boot overlying the toe area, and can be used to tighten down the boot over the toes, thereby providing the desired toe pressure. It should be understood that the present invention is not limited to either of these particular implementations, or even to the providing of some mechanism to increase toe pressure.

As should be appreciated from the foregoing, the various illustrative embodiments of the boot in accordance with the present invention do not employ a large metal plate that is attached to the boot sole as in many conventional strapless bindings, and is as comfortable to walk in as traditional boots employed with strap bindings. In this respect, the above-described boots in accordance with the present invention can be used not only with a binding having a strapless engagement member in accordance with the present invention, but can also be used in conjunction with a conventional strap binding.

Figure 14:
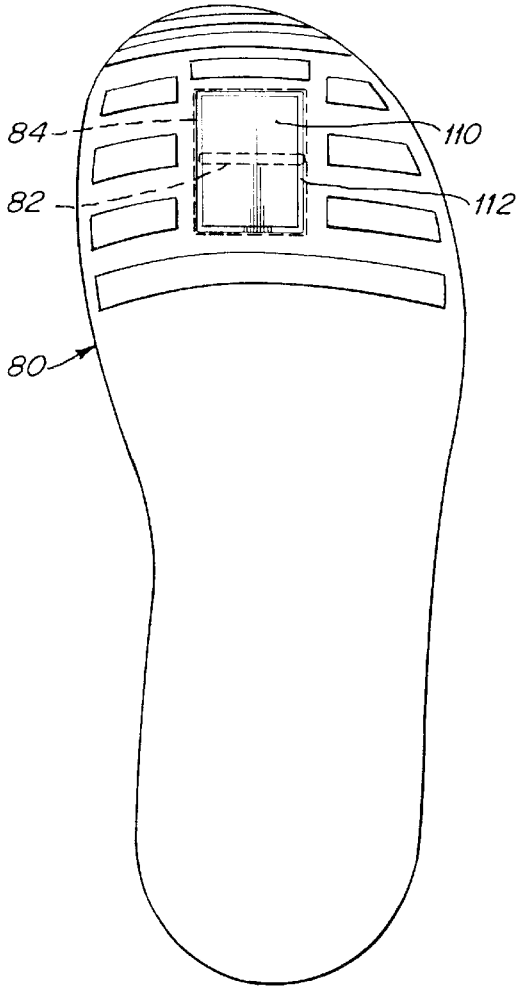
FIG. 14 is a bottom view of a boot including a removable patch in accordance with one embodiment of the invention for covering the mating feature adapted to mate with a binding engagement member.

In accordance with one illustrative embodiment of the invention shown in FIG. 14, the boot includes a plug 110 that covers the boot recess and binding mating feature (e.g., recess 84 and rod 82 in the embodiment of FIGS. 7–8), so that those features of the boot are not exposed to snow, dirt, and the like when the boot is to be employed with a strap binding. In the illustrative example shown in FIG. 14, the plug 110 is shown in connection with a boot of the type shown in FIGS. 7–8, with the rod 82 being shown in phantom as it is covered by the plug 110. It should be understood that any of the other embodiments of a boot in accordance with the present invention can also include a plug such as 110.

The plug 110 can be formed from the same material (e.g., rubber) as the outer sole of the boot, and can be formed integrally therewith. The border 112 of the plug 110 can be provided with a reduced thickness, thereby facilitating removal of the plug when the rider desires to expose the mating member (e.g., the rod 82 in FIG. 14) for use with a binding having a strapless engagement member in accordance with the present invention. The border 112 is provided with a thickness (e.g., 0.5–1 mm) that is relatively thin in comparison to the portion of the outer sole 86 that surrounds the border and the remainder of the patch 110. Thus, the border 112 will tear relatively easily so that the rider can remove the patch 110 by simply grasping it with a pair of pliers and pulling to separate the patch along the border 112, or by carefully using a knife or other sharp instrument to cut the patch at the border. The patch 110 can be provided with a visual indicator identifying the border 112 to facilitate removal of the patch.

Figure 15:
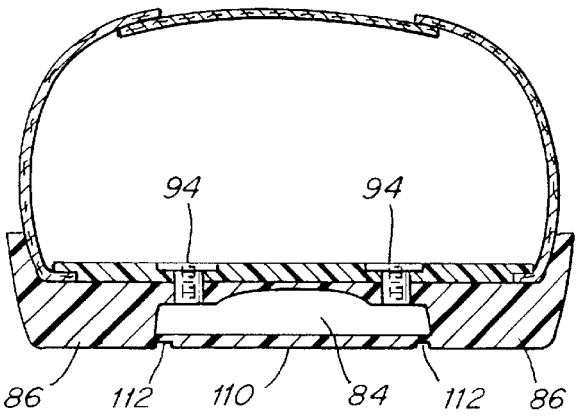
FIG. 15 is a cross-sectional view of a boot including a patch for covering a recess in the boot sole in which a mounting feature is provided for mounting a mating feature to the boot that is adapted to mate with a strapless binding engagement member in accordance with one illustrative embodiment of the invention.

In contrast with the embodiment of FIG. 14, wherein the boot is provided with the mating feature (e.g., 82) underlying the patch, in another illustrative embodiment of the invention shown in FIG. 15, the mating feature is not disposed under the patch 110. Rather, removal of the patch 110 reveals a mounting feature that is adapted to mount the mating feature within the boot recess. In the illustrative example shown in FIG. 15, the mounting feature includes a pair of T-nuts 94 as discussed above in connection with the embodiment of FIG. 10. Thus, when the plug 110 is removed, the rider can insert the mating member (e.g., the bar 92 in the embodiment of FIGS. 9–10) into the boot recess (e.g., 84 in FIGS. 9–10), and attach the mating member to the exposed mounting feature. For example, the bar 92 can be attached to the T-nuts 94 with a pair of screws in the manner described above in connection with FIGS. 9–10. Thus, when the boot shown in FIG. 15 is used in connection with a strap binding, the boot advantageously does not have the mating member attached thereto. Rather, it is only after the rider decides to employ the boot with a binding including a strapless engagement member that the plug 110 is removed, and the mating member (e.g., the bar 92 in FIGS. 9–10) is attached to the boot sole.

It should be understood that the particular mounting features 94 shown in the illustrative embodiment of FIG. 15 are provided merely for illustrative purposes. Other arrangements are possible. For example a single T-nut 94 can be employed, as well as any other mounting feature compatible with a similar or different type of mating feature. In this respect, the rider can use a single pair of boots to adapt with a strap binding and with multiple types of bindings having different strapless engagement members by switching between different mating features to be compatible with the different types of strapless engagement members.

In the embodiment of the invention shown in FIG. 15, the mounting features 94 are arranged to accommodate the mounting of the mating feature (e.g., bar 92 in FIGS. 9–10) in a single position. However, it should be appreciated that the boot can be provided with multiple mounting features that are arranged to mount the mating feature in two or more spaced locations, thereby providing the rider with some control over the precise positioning of the mating feature.

Figure 15A:
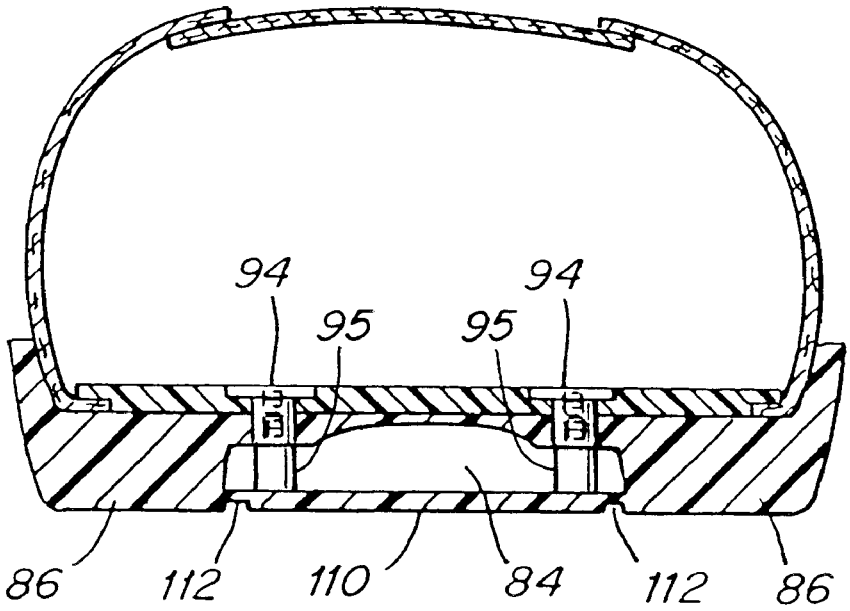
FIG. 15*a* is a cross-sectional view of a boot including a patch that is removably mounted to a mounting feature in the boot sole for covering a recess in the boot sole.

In the embodiments described above, it is contemplated that the patch 110 would be disposable, and not reattachable to the boot sole, such that once the rider decides to switch from a boot having a conventional sole for operation with a strap binding to one that is adapted to mate with a binding including a strapless engagement member, the patch would not be reattached. However, in another embodiment of the invention, it is contemplated that the patch 10 be reattachable to the boot sole after its removal. This can be done in any number of ways. For example, the patch can include a pair of screw holes adapted to receive screws for engagement into the mounting feature in the sole that receives the binding engagement member (e.g., T-nuts 94 shown in FIG. 15) to releasably engage the patch to the boot sole. Alternatively, the inner surface of the patch can include a pair of protrusions 95 (FIG. 15*a*) that are sized to fit within the T-nuts 94, such that the patch can be press-fitted into engagement therewith. In addition, the boot sole can be provided with a dedicated mounting feature, separate from that employed to mount the binding mating feature, to mount the reattachable patch to the sole. Thus, a reattachable patch can be used to cover not only the opening in the sole of the boot, but also the binding mating feature mounted therein. These particular implementations are provided merely for illustrative purposes, and it should be understood that the present invention is not limited to these or any other particular implementation of a reattachable patch.

Figure 18:
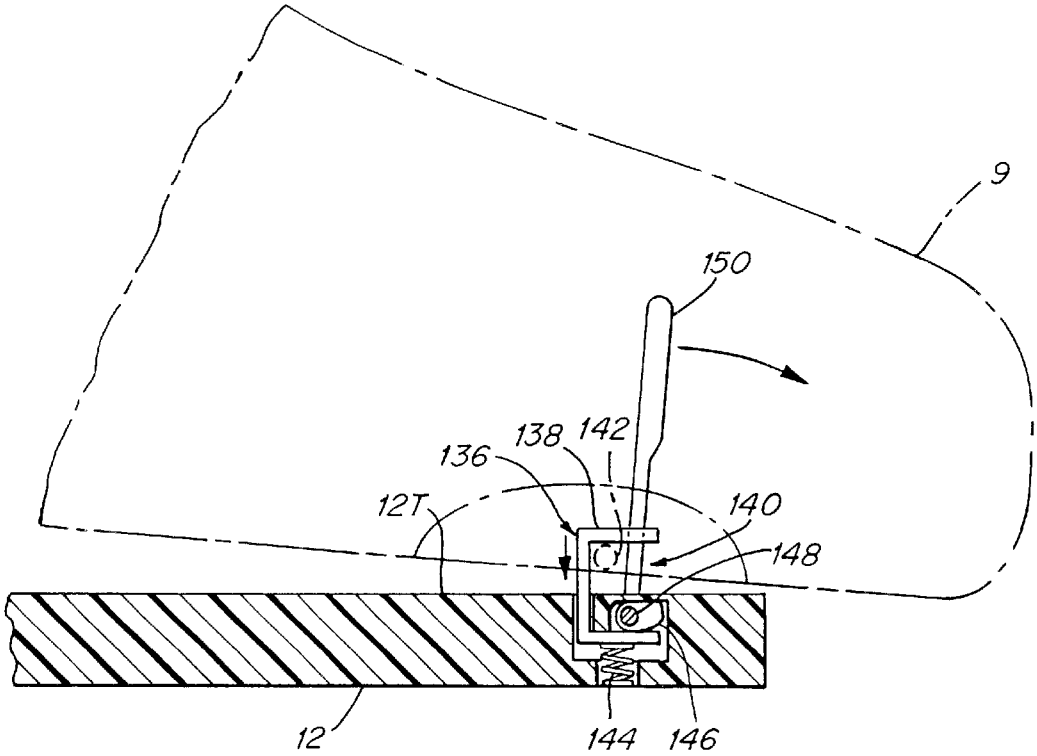
FIG. 18 is a partial schematic representation of an active strapless engagement member, in a boot-receiving position, in accordance with one illustrative embodiment of the invention.
Figure 19:
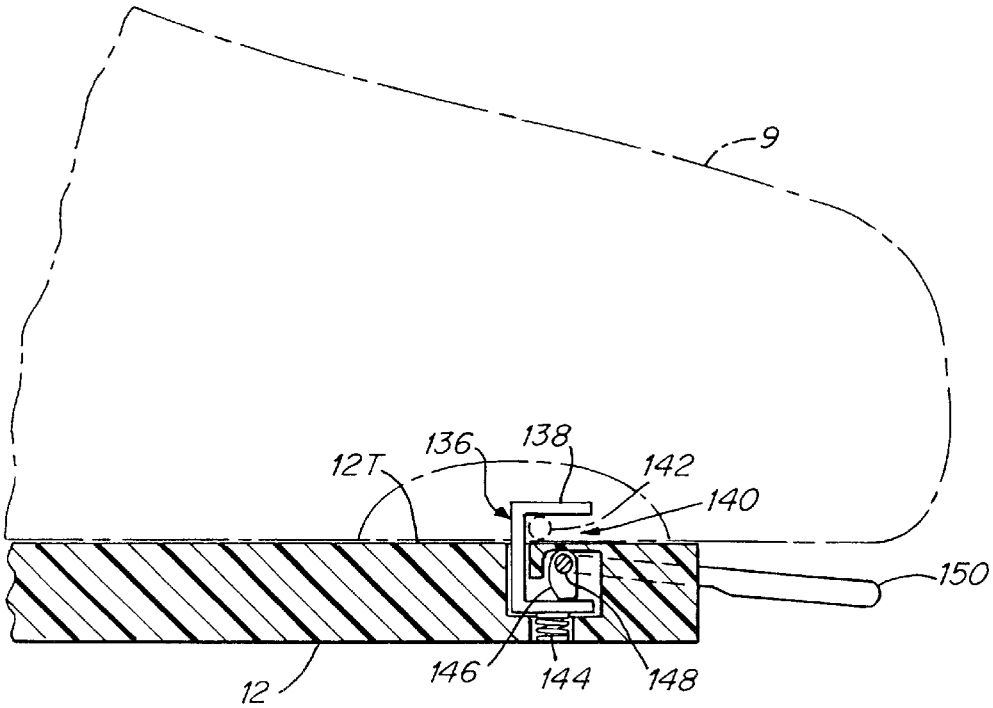
FIG. 19 is a partial schematic representation of the active strapless engagement member of FIG. 18 in a boot-locking position.

An alternate embodiment of the strapless engagement member is disclosed in FIGS. 18–19. In this embodiment of the invention, the strapless engagement member 136 includes a hook portion 138 that is similar in many respects to the hook 52 of the embodiment of the invention shown in FIGS. 2–4. However, in the embodiment of the invention shown in FIGS. 18–19, the engagement member 136 is active (i.e., has a movable portion), so that the opening 140 between the hook portion 138 and a top surface 12T of the base plate 12 can be altered from a larger opening size when the strapless engagement member is in the open position shown in FIG. 18, to a smaller size when the engagement member 136 is in the closed position shown in FIG. 19. Thus, the strapless engagement member 136 has an open position wherein it is relatively easy for the rider to engage and disengage, and a closed position wherein the hook portion 138 snuggly engages the boot mating feature 142 (which can be implemented in any of a number of ways as discussed above) to tightly hold down the boot when riding.

The active strapless engagement member 136 can be implemented in any of a number of ways, and the present invention is not limited to the particular implementation shown in FIGS. 18–19, which is provided merely for illustrative purposes. In the particular implementation shown in the figures, the strapless engagement member 136 is biased upwardly via a biasing element (e.g., a spring) 144. A cam 146 is mounted to the baseplate 12 for rotation about a pivot axis defined by a rod 148 extending across the baseplate 12. A lever 150 is attached to one end of the rod 148 and can be used by the rider to rotate the shaft 148, and consequently the cam 146 attached thereto. When the lever is rotated downwardly from the open position shown in FIG. 18 to the closed position shown in FIG. 19, the engagement between the cam 146 and the engagement member 136 causes the hook portion 138 to be pulled downwardly to the position shown in FIG. 19, wherein the boot mating feature 142 is tightly held between the hook portion 138 and the top surface 12T of the baseplate. To open the strapless engagement member at the end of a ride, the lever 150 is simply rotated in the reverse direction to the position shown in FIG. 18.

As mentioned above, the concept of the present invention related to the active strapless engagement member for actively engaging the boot mating feature is not limited to the particular implementation shown in the figures, as numerous other implementations are possible. All that is necessary is that some portion of the strapless engagement member be moveable between an open position that facilitates engagement with the boot mating feature, and a closed position wherein the boot mating feature is firmly held down.

Although the particular strapless engagement members disclosed herein have been described above in connection with a binding that includes a strap for holding down the heel of the boot in the binding, it should be understood that these aspects of the present invention are not so limited. In particular, the strapless engagement members described above can alternatively be employed with other types of bindings wherein they are used in conjunction with another strapless engagement member for holding the boot in the binding. Similarly, although the particular mating features of the boot and the patch disclosed for use therewith have been described above for use in connection with the types of bindings disclosed in this application, it should be understood that these aspects of the present invention are also not so limited, and that these features of the present invention can be employed with other types of bindings.

As mentioned above, the strapless forward engagement member in accordance with the present invention can be implemented in any number of ways. Although the illustrative embodiments of the invention shown in the drawings each employs a strapless engagement member in the form of a hook, the present invention is not limited to these or any other particular implementations. For example, the boot can be provided with a hook and the binding can be provided with a bar for engagement therewith. Alternatively, any arrangement that enables the boot to be held down while still experiencing lateral foot roll can be employed, including arrangements that do not employ a hook on either the boot or binding.

Having just described several illustrative embodiments of the invention, various alterations, modifications and improvements will readily occur to those skilled in the art. Such alterations, modifications and improvements are intended to be in the spirit and scope of the invention. Accordingly, the foregoing description is by way of example only and is not intended as limiting. The invention is limited only as defined in the following claims and the equivalence thereto.

What is claimed is:

1. A snowboard binding for securing a snowboard boot to a snowboard, the snowboard boot having a toe end, a heel end and a length extending between the toe and heel ends, the snowboard binding comprising:

a base having a medial side, a lateral side and a width extending between the medial and lateral sides;

a strapless engagement member mounted to the base, the strapless engagement member being arranged to engage with a portion of the snowboard boot that is disposed on a forward region of the boot extending between a center of the length of the boot and the toe end of the boot, the strapless engagement member being a hook defining an opening, the hook having a width extending across at least a portion of the width of the base, the width of the hook tapering from a narrower portion adjacent a mouth of the opening to a wider portion spaced from the mouth of the opening; and a strap that is mounted to the base and is arranged to engage with the boot to hold the heel end of the boot in the binding;

wherein the strapless engagement member is rotatably mounted to the base.

2. The snowboard binding of claim 1, wherein the strapless engagement member is biased for rotation relative to the base.

3. The snowboard binding of claim 2, wherein the strapless engagement member is biased so that the hook opening faces upwardly at an angle relative to a top surface of the base.

4. The snowboard binding of claim 3, wherein the base has a central longitudinal axis extending along a length of the base, and wherein the hook opening faces in a direction that is offset from the central longitudinal axis of the base.

5. The snowboard binding of claim 3, wherein the snowboard boot has a sole including an opening that is adapted to receive the strapless engagement member and includes lateral sidewalls, and wherein the strapless engagement member has a size and shape that is adapted to engage the lateral sidewalls to prevent side-to-side movement of the snowboard boot relative to the binding when the snowboard boot is engaged with the binding.

6. The snowboard binding of claim 5, wherein the base has a central longitudinal axis extending along a length of the base, and wherein the hook opening faces in a direction that is offset from the central longitudinal axis of the base.

7. The snowboard binding of claim 3, wherein the hook has a top portion and a bottom portion defining the hook opening therebetween, and wherein the base includes a recess that is adapted to receive the bottom portion of the hook so that the bottom portion of the hook is flush with a top surface of the base.

8. The snowboard binding of claim 3, wherein the binding has a heel end and a toe end, and wherein the hook opening faces the heel end of the binding.

9. The snowboard binding of claim 1, further including a spring that is disposed between the base and a portion of the strapless engagement member, the spring being arranged to bias the strapless engagement member for rotation relative to the base.

10. The snowboard binding of claim 9, wherein the spring is arranged to bias the strapless engagement member so that the hook opening faces upwardly at an angle relative to a top surface of the base.

11. The snowboard binding of claim 10, wherein the binding has a heel end and a toe end, and wherein the hook opening faces the heel end of the binding.

12. The snowboard binding of claim 1, wherein the snowboard boot has a sole including an opening that is adapted to receive the strapless engagement member and includes lateral sidewalls, and wherein the strapless engagement member has a size and shape that is adapted to engage the lateral sidewalls to prevent side-to-side movement of the snowboard boot relative to the binding when the snowboard boot is engaged with the binding.

13. The snowboard binding of claim 1, in combination with the snowboard boot.

14. A snowboard binding for securing a snowboard boot to a snowboard, the snowboard boot having a toe end, a heel end and a length extending between the toe and heel ends, the snowboard binding comprising:

a base having a medial side, a lateral side and a width extending between the medial and lateral sides;

strapless engagement member mounted to the base, the strapless engagement member being arranged to engage with a portion of the snowboard boot that is disposed on a forward region of the boot extending between a center of the length of the boot and the toe end of the boot, the strapless engagement member being a hook defining an opening, the hook having a width extending across at least a portion of the width of the base, the width of the hook tapering from a narrower portion adjacent a mouth of the opening to a wider portion spaced from the mouth of the opening; and a strap that is mounted to the base and is arranged to engage with the boot to hold the heel end of the boot in the binding;

wherein the hook has a top portion and a bottom portion defining the hook opening therebetween, and wherein the base includes a recess that is adapted to receive the bottom portion of the hook so that the bottom portion of the hook is flush with a top surface of the base.

15. The snowboard binding of claim 14, wherein the binding further includes a rigid heel support adapted to support the heel end of the snowboard boot.

16. The snowboard binding of claim 14, wherein the snowboard boot includes a sole, and wherein the strapless engagement member is positioned on the base to underlie the sole of the snowboard boot when the snowboard boot is engaged in the binding.

17. The snowboard binding of claim 14, wherein the snowboard boot has a sole, and wherein the strapless engagement member and the strap are arranged to enable the sole of the snowboard boot to roll laterally with respect to the base of the binding.

18. A snowboard binding for securing a snowboard boot to a snowboard, the snowboard boot having a toe end, a heel end and a length extending between the toe and heel ends, the snowboard binding comprising:

a base having a medial side, a lateral side and a width extending between the medial and lateral sides;

a strapless engagement member mounted to the base, the strapless engagement member being arranged to engage with a portion of the snowboard boot that is disposed on a forward region of the boot extending between a center of the length of the boot and the toe end of the boot, the strapless engagement member being a hook defining an opening, the hook having a width extending across at least a portion of the width of the base, the width of the hook tapering from a narrower portion adjacent a mouth of the opening to a wider portion spaced from the mouth of the opening; and a strap that is mounted to the base and is arranged to engage with the boot to hold the heel end of the boot in the binding;

wherein the snowboard boot has a sole including an opening that is adapted to receive the strapless engagement member and includes lateral sidewalls, and wherein the strapless engagement member has a size and shape that is adapted to engage the lateral sidewalls to prevent side-to-side movement of the snowboard boot relative to the binding when the snowboard boot is engaged with the binding;

wherein the hook has a top portion and a bottom portion defining the hook opening therebetween, and wherein the base includes a recess that is adapted to receive the bottom portion of the hook so that the bottom portion of the hook is flush with a top surface of the base.

19. A snowboard binding for securing a snowboard boot to a snowboard,the snowboard boot having a toe end, a heel end and a length extending between the toe and heel ends, the snowboard binding comprising:

a base;

a hold down disk;

a strapless engagement member, movably mounted to the base, that is adapted to engage with the snowboard boot, the strapless engagement member being mounted to the base at a position on the base that is arranged to underlie the sole of the snowboard boot when the snowboard boot is engaged by the binding, the strapless engagement member being arranged to engage with a portion of the snowboard boot that is disposed on a forward region of the boot extending between a center of the length of the boot and the toe end of the boot, the strapless engagement member being biased for movement relative to the base; and a strap that is mounted to the base and is arranged to engage with the boot to hold the heel end of the boot in the binding.

20. The snowboard binding of claim 19, wherein the binding has a heel end and a toe end, and wherein the strapless engagement member is a hook having an opening facing the heel end of the binding.

21. The snowboard binding of claim 19, wherein the strapless engagement member is rotatably mounted to the base.

22. The snowboard binding of claim 21, further including a spring that is disposed between the base and a portion of the strapless engagement member, the spring being arranged to bias the strapless engagement member for rotation relative to the base.

23. The snowboard binding of claim 21, wherein the strapless engagement member includes a hook having a top portion and a bottom portion defining an opening therebetween, and wherein the base includes a recess that is adapted to receive the bottom portion of the hook so that the bottom portion of the hook is flush with a top surface of the base.

24. The snowboard binding of claim 22, wherein the strapless engagement member is a hook having an opening, and wherein the spring is arranged to bias the strapless engagement member so that the hook opening faces upwardly at an angle relative to a top surface of the base.

25. The snowboard binding of claim 19, wherein the strapless engagement member is a hook having an opening, and wherein the strapless engagement member is biased so that the hook opening faces upwardly at an angle relative to a top surface of the base.

26. The snowboard binding of claim 19, wherein the strapless engagement member includes a hook defining an opening, the hook having a width that tapers from a narrowest point adjacent a mouth of the opening to a wider point spaced from the mouth of the opening.

27. The snowboard binding of claim 19, in combination with the snowboard boot.

28. A snowboard binding for securing a snowboard boot to a snowboard, the snowboard boot having a toe end, a heel end and a length extending between the toe and heel ends, the snowboard boot including a sole, the snowboard binding comprising:

a base having a toe end, a heel end, a medial side, a lateral side and a width extending between the medial and lateral sides;

a strapless engagement member mounted to the base, the strapless engagement member being mounted at a position on the base that is arranged to underlie the sole of the snowboard boot when the snowboard boot is engaged by the binding, the strapless engagement member having an opening adapted to receive a corresponding mating feature on the snowboard boot, the strapless engagement member being arranged so that the opening faces the toe end of the base, the strapless engagement member having a width extending across at least a portion of the width of the base, the width of the strapless engagement member tapering from a narrowest portion adjacent a mouth of the opening to a wider portion spaced from the mouth of the opening; and a strap that is mounted to the base and is arranged to engage with the boot to hold the heel end of the boot in the binding.

29. The snowboard binding of claim 28, wherein the base includes a plurality of mounting features adapted to adjustably mount the strapless engagement member to the base in either of at least two different mounting positions so that the binding can accommodate snowboard boots of at least two different sizes.

30. The snowboard binding of claim 28, wherein the snowboard boot has a sole including an opening that is adapted to receive the strapless engagement member and includes lateral sidewalls, and wherein the strapless engagement member has a size and shape that is adapted to engage the lateral sidewalls to prevent side-to-side movement of the snowboard boot relative to the binding when the snowboard boot is engaged with the binding.

31. The snowboard binding of claim 30, wherein the sole opening is a cavity in the sole that is adapted to receive the strapless engagement member, and wherein the strapless engagement member has a size and shape that is adapted to substantially fill the cavity.

32. The snowboard binding of claim 30, wherein the sole opening is a recess in the sole that is adapted to receive the strapless engagement member, and wherein the strapless engagement member has a size and shape that is adapted to substantially fill the recess.

33. The snowboard binding of claim 28, further including at least one forward strap mounting feature, mounted to the base, that is adapted to mount a forward strap to the binding to engage with a portion of the snowboard boot that is disposed between the center of the length of the boot and the toe end of the boot.

34. The snowboard binding of claim 28, wherein the base and the strapless engagement member are formed from a same material.

35. The snowboard binding of claim 34, wherein the base and the strapless engagement member are molded as a single integral piece.

36. The snowboard binding of claim 28, wherein the base has medial side, a lateral side and a central longitudinal axis extending along a length of the base from a rear edge of the base to a forward edge of the base, wherein the strapless engagement member has an engaging portion that is adapted to engage the snowboard boot, and wherein the engaging portion of the strapless engagement member is offset from the central longitudinal axis toward the medial side of the base.

37. The snowboard binding of claim 28, wherein the base has medial side, a lateral side and a central longitudinal axis extending along a length of the base from a rear edge of the base to a forward edge of the base, wherein the strapless engagement member has an engaging portion that is adapted to engage the snowboard boot, and wherein the engaging portion of the strapless engagement member is offset from the central longitudinal axis toward the lateral side of the base.

38. The snowboard binding of claim 28, wherein the width of the opening is within a range from 5 mm to 3 cm.

39. The snowboard binding of claim 28, wherein the strapless engagement member is a hook.

40. The snowboard binding of claim 28, wherein the base has a central longitudinal axis extending along a length of the base, and wherein the opening faces in a direction that is offset from the central longitudinal axis of the base.

41. The snowboard binding of claim 40, wherein the binding has a medial side and a lateral side, and wherein the strapless engagement member is mounted to the base so that the direction in which the opening faces is offset toward the medial side of the binding.

42. The snowboard binding of claim 40, wherein the strapless engagement member is arranged to engage with a portion of the snowboard boot that is disposed on a forward region of the boot extending between a center of the length of the boot and the toe end of the boot.

43. The snowboard binding of claim 28, wherein the snowboard boot has a sole including an opening that is adapted to receive the strapless engagement member and includes lateral sidewalls, and wherein the strapless engagement member has a size and shape that is adapted to engage the lateral sidewalls to prevent side-to-side movement of the snowboard boot relative to the binding when the snowboard boot is engaged with the binding.

44. The snowboard binding of claim 43, wherein the sole opening is a cavity in the sole that is adapted to receive the strapless engagement member, and wherein the strapless engagement member has a size and shape that is adapted to substantially fill the cavity.

45. The snowboard binding of claim 43, wherein the sole opening is a recess in the sole that is adapted to receive the strapless engagement member, and wherein the strapless engagement member has a size and shape that is adapted to substantially fill the recess.

46. The snowboard binding of claim 28, wherein the strapless engagement member includes a hook having a width within a range from 5 mm to 3 cm.

47. The snowboard binding of claim 28, wherein the strapless engagement member includes a hook having a top portion and a bottom portion defining the opening therebetween, and wherein the base includes a recess that is adapted to receive the bottom portion of the hook so that the bottom portion of the hook is flush with a top surface of the base.

48. The snowboard binding of claim 28, wherein the strapless engagement member is arranged to enable the sole of the snowboard boot to roll laterally with respect to the base of the binding.

49. The snowboard binding of claim 28, wherein the binding further includes a rigid heel support adapted to support the heel end of the snowboard boot.

50. The snowboard binding of claim 49, further including a high-back leg support mounted to the base at the heel end of the binding.

51. The snowboard binding of claim 49, wherein the strapless engagement member is arranged to engage with a portion of the snowboard boot that is disposed on a forward region of the boot extending between a center of the length of the boot and the toe end of the boot.

52. The snowboard binding of claim 28, wherein the binding is not automatically releasable.

53. The snowboard binding of claim 28, wherein the strapless engagement member is arranged to engage with a portion of the snowboard boot that is disposed on a forward region of the boot extending between a center of the length of the boot and the toe end of the boot.

54. The snowboard binding of claim 28, in combination with the snowboard boot.

55. A snowboard binding for securing a snowboard boot to a snowboard, the snowboard having an upper surface, the snowboard boot having a toe end, a heel end and a length extending between the toe and heel ends, the snowboard boot including a sole, the snowboard binding comprising:

a base arranged to overlie the upper surface of the snowboard and having a toe end a heel end; and a strapless engagement member mounted to the base, the strapless engagement member being mounted at a position on the base that is arranged to underlie the sole of the snowboard boot when the snowboard boot is engaged by the binding, the strapless engagement member having an opening adapted to receive a corresponding mating feature on the snowboard boot, the strapless engagement member having a portion thereof that is movable toward the upper surface of the snowboard from a first position wherein the opening has a first size to a second position wherein the opening has a second size that is smaller than the first size, and further being movable away from the upper surface from the second position to the first position.

56. The snowboard binding of claim 53, wherein the opening is formed between a portion of the strapless engagement member and a top surface of the base plate.

57. The snowboard binding of claim 56, further including a strap that is mounted to the base and is arranged to engage with the boot to hold the heel end of the boot in the binding.

58. The snowboard binding of claim 56, wherein the strapless engagement member is movably mounted to the base plate.

59. The snowboard binding of claim 58, wherein the movable portion of the strapless engagement member is biased into the first position.

60. The snowboard binding of claim 59, further including a strap that is mounted to the base and is arranged to engage with the boot to hold the heel end of the boot in the binding.

61. The snowboard binding of claim 55, wherein the movable portion of the strapless engagement member is biased into the first position.

62. The snowboard binding of claim 61, further including a strap that is mounted to the base and is arranged to engage with the boot to hold the heel end of the boot in the binding.

63. The snowboard binding of claim 55, further including a lever, mechanically coupled to the strapless engagement member, that is adapted to move the movable portion of the strapless engagement member from the first position to the second position.

64. The snowboard binding of claim 55, wherein the strapless engagement member is arranged to engage with a portion of the snowboard boot that is disposed on a forward region of the boot extending between a center of the length of the boot and the toe end of the boot.

65. The snowboard binding of claim 64, further including a strap that is mounted to the base and is arranged to engage with the boot to hold the heel end of the boot in the binding.

66. The snowboard binding of claim 55, further including a strap that is mounted to the base and is arranged to engage with the boot to hold the heel end of the boot in the binding.

67. The snowboard binding of claim 55, wherein the strapless engagement member is a hook.

68. The snowboard binding of claim 55, wherein the snowboard boot has a sole including a recess that is adapted to receive the strapless engagement member and includes lateral sidewalls, and wherein the strapless engagement member has a size and shape that is adapted to engage the lateral sidewalls to prevent side-to-side movement of the snowboard boot relative to the binding when the snowboard boot is engaged with the binding.

69. The snowboard binding of claim 55, wherein the strapless engagement member includes a hook having a top portion and a bottom portion, and wherein the base includes a recess that is adapted to receive the bottom portion of the hook.

70. The snowboard binding of claim 55, wherein the strapless engagement member is arranged to enable the sole of the snowboard boot to roll laterally with respect to the base of the binding.

71. The snowboard binding of claim 55, wherein the binding further includes a rigid heel support adapted to support the heel end of the snowboard boot.

72. The snowboard binding of claim 55, further including a high-back leg support mounted to the base at the heel end of the binding.

73. The snowboard binding of claim 55, in combination with the snowboard boot.

* * * * *